US010463183B2

(12) United States Patent
Gouldson

(10) Patent No.: US 10,463,183 B2
(45) Date of Patent: Nov. 5, 2019

(54) GARMENT HANGER WITH REUSABLE LOWER NECK SIZER

(71) Applicant: BRAIFORM (HK) LTD., Hong Kong (CN)

(72) Inventor: Stanley F. Gouldson, Northport, NY (US)

(73) Assignee: BRAIFORM (HK) LTD., Kwun Tong (HK)

( * ) Notice: Subject to any disclaimer, the term of this patent is extended or adjusted under 35 U.S.C. 154(b) by 693 days.

(21) Appl. No.: 15/049,910

(22) Filed: Feb. 22, 2016

(65) Prior Publication Data

US 2016/0166097 A1 Jun. 16, 2016

Related U.S. Application Data

(60) Division of application No. 13/340,242, filed on Jun. 13, 2012, now Pat. No. 9,265,373, which is a continuation-in-part of application No. 13/168,520, filed on Jun. 24, 2011, now abandoned, which is a continuation-in-part of application No. 12/395,834, filed on Mar. 2, 2009, now Pat. No. 8,113,392, and a continuation-in-part of application No. 12/370,902, filed on Feb. 13, 2009, now Pat. No. 8,763,867.

(51) Int. Cl.
*A47G 25/14* (2006.01)

(52) U.S. Cl.
CPC ..... *A47G 25/1428* (2013.01); *Y10T 29/49815* (2015.01); *Y10T 29/49826* (2015.01)

(58) Field of Classification Search
CPC ..... A47G 25/1407; A47G 25/1414; A47G 25/1425; A47G 25/1428; A47G 25/1435
See application file for complete search history.

(56) References Cited

U.S. PATENT DOCUMENTS

| | | | | |
|---|---|---|---|---|
| 7,287,674 | B1 * | 10/2007 | Sutton | A47G 25/1428 223/85 |
| 7,832,602 | B2 * | 11/2010 | Ho | A47G 25/1428 223/85 |
| 7,874,468 | B2 * | 1/2011 | Hansen | G09F 3/04 223/85 |
| 2006/0006204 | A1 * | 1/2006 | Mainetti | A47G 25/1428 223/85 |
| 2007/0062984 | A1 * | 3/2007 | Louw | A47G 25/1428 223/85 |
| 2010/0147907 | A1 * | 6/2010 | Goldman | G09F 3/04 223/85 |
| 2013/0200114 | A1 * | 8/2013 | Yau | A47G 25/1407 223/85 |

* cited by examiner

*Primary Examiner* — Nathan E Durham
(74) *Attorney, Agent, or Firm* — Scully, Scott, Murphy & Presser, P.C.

(57) ABSTRACT

In a combination of a garment hanger and a reusable indicator for displaying garment-related information, the indicator can be attached to and removed from a lower neck region of the hanger where a hanger post intersects the hanger body. The hanger includes an indicator retaining member for providing indicator retaining interference with the indicator to retain the indicator at the lower neck region. The hanger further includes structure for providing pivots upon which the indicator can be flexed to remove the indicator from the hanger. The indicator can include a discontinuity for admitting a hanger hook and assisting deformation of the indicator. The indicator can be deformed along the discontinuity to remove the indicator from the hanger.

10 Claims, 20 Drawing Sheets

GARMENT HANGER WITH REUSABLE LOWER NECK SIZER

CROSS-REFERENCE TO RELATED APPLICATIONS

This application is a divisional application of co-pending U.S. patent application Ser. No. 13/340,242 (filed Jun. 13, 2012), which is a continuation-in-part of U.S. patent application Ser. No. 13/168,520 (filed Jun. 24, 2011), which is a continuation-in-part of U.S. patent application Ser. No. 12/370,902 (filed Feb. 13, 2009) and U.S. patent application Ser. No. 12/395,834 (filed Mar. 2, 2009). The complete disclosure of these applications is hereby incorporated by reference for all purposes.

BACKGROUND

Field

The present disclosure relates generally to the field of garment hangers as are widely used for the purpose of packaging, shipping and displaying garments, and more particularly to a combination of a plastic molded garment hanger and a reusable lower neck indicator capable of being removably attached to the hanger at a lower neck region thereof Description of Related Art In the area of retail garment sales, so-called Garment-On-Hanger (GOH) programs have become preferred by retailers. In a GOH program, garments are delivered to retail merchants already suspended from hangers, where upon arrival at the retail location the garments are immediately placed on display for sale.

In particular, retailers have specified particular hangers or hanger characteristics among suppliers in order to achieve uniformity on their sales floors. To this end, standards as to hanger size, shape, performance characteristics, etc., are maintained, for example, by organizations such as the Voluntary Inter-industry Commerce Standards Association (VICS). Intimate apparel hangers, pinch grip hangers, top garment hangers and so on are among the standardized hangers under the VICS standards.

Additionally, and interrelated to the promulgation of GOH programs, retailers and their customers desire to have the hanger itself display some indicia regarding the item carried upon it. Categories of indicia include origin of manufacturer, materials of the garments and prices of the garments, but mostly the sizes of garments. Among the various means developed for accomplishing this, so-called lower neck indicators are widely applied and recognized in the industry. Lower neck indicators are secured to the hanger at or adjacent the intersection of the hook and the hanger body, to provide a displaying surface on which garment sizes are printed.

Normally, the lower neck indicators are secured to the hangers, either manually or automatically, at the manufacturers' cost. Thus, it is desirable in the industry to easily and quickly attach the indicators to the hangers. Accordingly, assembling efficiency can be improved and manufacturing cost of the hangers and the indicators can be reduced, which in turn offers a significant commercial advantage to the manufacturers, transporters, as well as retailers in the industry.

Furthermore, it is desirable in the industry to securely attach the indicators to the hangers. The reliable affixation of the indicators to the hangers in the GOH program prevents the indicators from accidentally and unintentionally detaching from the hangers. Specifically, under industry standards, such as the VICS, it is required to maintain a certain degree of affixation of the indicator to the hanger to avoid young children from swallowing an indicator after the indicator is accidentally detached from a hanger, so as to provide so-called "child proof" hangers.

At the same time, it is also desirable to allow the indicators to be removed by a user from the hangers through simple operations. Thus, the hangers and indicators can be sorted and reused according an indicator-reuse methodology, which is described in co-owned U.S. Pat. No. 6,523,240, the entire disclosure of which is incorporated herein for all purposes. With the continuing consumption of the natural resources, it is popular and necessary in the manufacturing industry to optimize the product design to save materials and energy and concomitantly reduce the manufacturing and transportation costs, without compromising performance. The resultant product under such a material and energy saving concept is recognized as an environmentally friendly product, and is much more market competitive than its prior art counterpart. In the hanger molding industry, millions of plastic hangers and indicators are manufactured each year. Normally, the indicators are made of a material different from that of the hangers, which provides the indicators a relatively longer useful life. The removable characteristics of indicators would allow millions of indicators to be collected and reused. Thus, in view of the significant manufacture volume, reusable hangers and indicators are environmentally friendly and provide a commercial advantage to the manufacturer, transporter and retailer in the industry.

Accordingly, there is a need in the industry for improved garment hanger and indicator, which enable easy, quick and secure attachment of the indicator to the hanger while still maintaining the reusable characteristics of the indicator so as to provide an environmental friendly product.

BRIEF SUMMARY

Therefore, in order to overcome certain deficiencies of the prior art, provided according to one aspect of the present invention is a garment hanger. The hanger includes a hanger body having a first lateral width; a post extending upwardly from the body and a hook retained in the post, the intersection of the post and the hanger body defining a lower neck region of the hanger; at least one indicator retaining member vertically distanced form the hanger body and extending outwardly from the post for retaining the indicator at the lower neck region; at least one strut angularly disposed between the post and the body, the strut comprising a bottom end having a second lateral width substantially equal to the first lateral width; and at least one projection disposed on an outer surface of the post.

Preferably, the hanger body includes a body flange and the first lateral width is the lateral width of the body flange.

Preferably, the at least one indicator retaining member includes at least one flange configured to operatively engage a resilient tab of the indicator. Preferably, the at least one indicator retaining member includes at least one ring configured to engage a top wall of the indicator.

Preferably, the at least one projection includes at least one substantially half-spherical protrusion. Preferably, the at least one projection includes at least one vertically extending rib.

Preferably, the post is substantially cylindrical. Preferably, the post includes a substantially planar front outer surface and a substantially planar rear outer surface and the at least one projection is disposed on the front outer surface or the rear outer surface of the post.

Preferably, the hanger body includes a first arm and a second arm extending oppositely to one another.

According to another aspect of the present invention, provided is a reusable lower neck indicator. The indicator includes a pair of opposite sidewalls connected by a pair of end walls for providing a substantially trapezoidal indicator body having four lower corners; a top opening and a bottom opening at the top end and the bottom end of the indicator, respectively; and at least one elevation disposed on an inner surface of the sidewalls at one of the four lower corners.

Preferably, the reusable lower neck indicator further includes a pair of resilient tabs formed at the upper end of the end walls, respectively, each tab defined by a pair of elongated slots substantially bounding the sides of the resilient tab, the resilient tabs each comprising a free upper end displaceable to enlarge the top opening of the indicator to allow the indicator to pass over a post of the hanger.

Preferably, the indicator further includes a discontinuity communicating the top opening and the bottom opening.

Preferably, the discontinuity is disposed in a sidewall of the indicator and includes a slot continuous with the top opening and a cutout continuous with the bottom opening. More preferably, the cutout s substantially triangular with the apex thereof continuous with the slot.

Preferably, the discontinuity is disposed in an end wall and includes a substantially consistent slot connecting the top opening and the bottom opening.

Preferably, the reusable lower neck indicator further includes a top wall for defining the top opening. The top opening has a pair of opposite curved sides connected by a pair of opposite straight sides, defined in the top wall. The top opening is substantially in compliance with the outer profile of a post of the hanger.

According to another aspect of the present invention, provided is a reusable lower neck indicator. The indicator includes a pair of opposite sidewalls connected by a pair of end walls for providing a substantially trapezoidal indicator body having four lower corners, a top opening at the top end of the indicator and a bottom opening at the bottom end of the indicator and at least one discontinuity communicating the top opening and the bottom opening.

Preferably, the indicator further comprises a top wall for defining the top opening. Preferably, the top opening has a pair of opposite curved sides connected by a pair of opposite straight sides defined in the top wall. The top opening is substantially in compliance with the outer profile of a post of the hanger.

Preferably, the at least one discontinuity includes a slot continuous with the top opening and a cutout continuous with the bottom opening. More preferably, the cutout is substantially triangular with the apex thereof continuous with the slot.

Preferably, the discontinuity includes at least one substantially consistent slot communicating the top opening and the bottom opening.

Preferably, the reusable lower neck indicator further comprises at least one elevation disposed on an inner surface of the sidewalls adjacent one of the four lower corners.

According to another aspect of the present invention, provided is a combination including a hanger and an indicator removably attachable to the lower neck region of the hanger for displaying information. The hanger includes: a hanger body having a first lateral width; a post extending upward from the body and a hook retained in the post, the intersection of the post and the hanger body defining a lower neck region of the hanger; at least one indicator retaining member vertically distanced from the hanger body and extending outwardly from the post; at least one strut angularly disposed between the post and the body, the strut comprising a bottom end having a second lateral width substantially equal to the first lateral width; and at least one projection disposed on an outer surface of the post. The indicator includes: a pair of opposite sidewalls connected by a pair of end walls for providing a substantially trapezoidal body of the indicator having four corners; a top opening and a bottom opening at the top end and the bottom end of the indicator, respectively; and at least one elevation disposed on an inner surface of the sidewalls at one of the four corners. The at least one indicator retaining member provides indicator retaining interference with the indicator to retain the indicator at the lower neck region. When the indicator is attached to the lower neck region of the hanger, the at least one elevation is positioned against the bottom end of the strut to provide a pivot for deforming the indicator. When the indicator is attached to the lower neck region of the hanger, the at least one projection is positioned against one of the sidewalls to provide a pivot for deforming the indicator.

Preferably, the indicator includes a pair of resilient tabs formed at the upper end of the end walls, respectively, and the indicator retaining member comprises at least one flange configured to operatively engage the pair of resilient tabs to retain the indicator at the lower neck region of the hanger.

Preferably, the indicator further includes a top wall for defining the top opening and the indicator retaining member comprises at least a ring configured to operatively engage the top wall of the indicator to retain the indicator at the lower neck region of the hanger.

Preferably, the indicator further includes a discontinuity communicating the top opening and the bottom opening.

Preferably, the discontinuity is disposed in a sidewall of the indicator and includes a slot continuous with the top opening and a cutout continuous with the bottom opening. More preferably, the cutout is substantially triangular with the apex thereof continuous with the slot.

Preferably, the discontinuity is disposed in an end wall and includes a substantially consistent slot connecting the top opening and the bottom opening.

Preferably, the at least one projection includes at least one substantially half-spherical protrusion. Preferably, the at least one projection comprises at least one vertically extending rib.

Preferably, the post is substantially cylindrical. More preferably, the post includes a substantially planar front outer surface and a substantially planar rear outer surface and the at least one projection is disposed on the front outer surface or the rear outer surface.

Preferably, wherein the top opening has a pair of opposite curved sides connected by a pair of opposite straight sides. More preferably, the top opening is in substantially compliance with the outer profile of the post.

Preferably, the hanger body includes a first arm and a second arm extending oppositely to one another.

According to another aspect of the present invention, provided is a method for removing an indicator from a hanger. The hanger includes a hanger body, a post extending upwardly from the hanger body and an indicator retaining member associated with the post for engaging the indicator to position the indicator at a lower neck region of the hanger. The method includes flexing the indicator with respect to the pivot to disengage the indicator from the indicator retaining member and separating the indicator from the hanger, wherein the pivot is provided on the hanger upon which the indicator is capable of being resiliently flexed.

Preferably, the step of flexing includes twisting the indicator with respect to the pivot in a plane substantially perpendicular to the post.

Preferably, the pivot further includes an expanded bottom end of a support strut as a pivot for resiliently flexing the indicator, the expanded end having a lateral width substantially equal to a lateral width of the hanger body. Preferably, the pivot includes at least one elevation disposed on an inner surface of the sidewalls, which faces the expanded bottom end of the strut when the indicator is positioned at the lower neck region. Preferably, the pivot further includes a projection on a surface of the post. The projection can be a substantially semi-spherical protrusion provided on the surface at a location adjacent the top of the post or a rib vertically extending between the top of the post and the hanger body.

According to another aspect of the present invention, provided is a method for manipulating a garment hanger and an indicator mountable to a lower neck region of a garment hanger. The hanger includes a hanger body, a post extending upwardly from the hanger body for receiving a hanger hook therein and an indicator retaining member associated with the post for engaging the indicator, the intersection of the hanger body and the post defining the lower neck region of the hanger.

The method includes feeding the indicator over the hook of the hanger, sliding the indicator downwardly along the hook to approach the indicator retaining member, engaging the indicator with the indicator retaining member to resiliently expand a top opening of the indicator and hanger to allow the indicator to pass over the indicator retaining structure, and positioning the indicator at the lower neck region. The manipulating method further includes flexing the indicator with respect to the pivot to disengage the indicator from the indicator retaining member and separating the indicator from the hanger, wherein the pivot is provided on the hanger upon which the indicator is capable of being resiliently flexed.

Preferably, the pivot includes an expanded bottom end of a strut disposed angularly between the hanger body and the post, the expanded end having a lateral width substantially equal to a lateral width of the hanger body. Preferably, the pivot includes at least one elevation disposed on an inner surface of the sidewalls, which faces the expanded bottom end of the strut when the indicator is positioned at the lower neck region. Preferably, the pivot includes at least one projection on a surface of the post. The projection can be a substantially semi-spherical protrusion on a front surface of the post at a location adjacent the top of the post or a rib extending between a top of the post and the hanger body. Preferably, the step of flexing includes twisting the indicator with respect to the pivot in a plane substantially perpendicular to the post.

According to another aspect of the present invention, provided is a method for attaching an indicator to a lower neck region of a hanger. The hanger includes a hanger body, a post extending upwardly from the hanger body for receiving a hanger hook therein and an indicator retaining member associated with the post for engaging the indicator. The lower neck region is defined by the intersection of the hanger body and the post. The indicator has a top opening and a bottom opening for admitting the post of the hanger.

The attaching method includes inserting the hook into an admitting end of a discontinuity, moving the hook along the discontinuity to allow the hook to enter the top opening and the bottom opening, and manipulating the indicator to engage the indicator with the indicator retaining member, wherein the discontinuity communicates the top opening and the bottom opening and is dimensioned to admit the hook. The engagement between the indicator and the indicator retaining member expands the top opening of the indicator to position the indicator at the lower neck region.

Preferably, the indicator includes opposite front and rear sidewalls and opposite left and right end walls, which defines a substantially trapezoidal profile of the indicator. Preferably, the discontinuity includes a substantially consistent discontinuity in at least one of the end walls. Preferably, the discontinuity is disposed in at least one of the sidewalls, which includes a lower cutout continuous with the bottom opening of the indicator and an upper slot continuous with the top opening of the indicator. Preferably, the lower cutout is a substantially triangular with the apex thereof continuous with the upper slot.

According to the above attaching method, the hanger hook slides along the discontinuity to enter both the top opening and the bottom opening. Compared to the traditional way of sliding the indicator over the hook to approach the lower neck region of the hanger, the above attaching method is capable of significantly improving the mounting efficiency, particularly when the method is implemented automatically by a machine.

According to another aspect of the present invention, provided is a method for removing an indicator from a lower neck region of a hanger. The hanger includes a hanger body, a post extending upwardly from the hanger body for receiving a hanger hook therein and an indicator retaining member associated with the post for engaging the indicator. The lower neck region of the hanger is defined by the intersection of the hanger body and the post. The indicator has a top opening and a bottom opening. The removing method includes flexing the indicator to partially deform the indicator along a discontinuity of the indicator, disengaging the indicator from the indicator retaining member of the hanger upon the deformation of the indicator, and separating the indicator from the hanger, wherein the discontinuity communicates the top opening and the bottom opening.

Preferably, the indicator can be separated from the hanger by ejecting the indicator from the post of the hanger upon the deformation of the indicator and moving the hook along the discontinuity to discharge the hook from the top opening and the bottom opening.

Preferably, the indicator includes opposite front and rear sidewalls and opposite left and right end walls, which define a substantially trapezoidal profile of the indicator. The discontinuity includes a substantially consistent slot in at least one of the end walls. The discontinuity includes a lower cutout continuous with the bottom opening of the indicator and an upper slot continuous with the top opening of the indicator in at least one of the sidewalls. More preferably, the lower cutout is substantially triangular with the apex thereof continuous with the upper slot.

According to the above removing method, the indicator is capable of being swiftly ejected from the hanger post under the action of the resilient deformation of the indicator along the discontinuity. Compared to the traditional way of disengaging the indicator from the indicator retaining member and sliding the indicator along the hook to the end of the hook, the above removing method is capable of significantly improving the removing efficiency, particularly when the method is implemented automatically by a machine.

According to another aspect of the present invention, provided is a method for manipulating a garment hanger and an indicator mountable to a lower neck region of a garment hanger. The hanger includes a hanger body, a post extending upwardly from the hanger body for receiving a hanger hook therein and an indicator retaining member associated with the post for engaging the indicator. The lower neck region of the hanger is defined by the intersection of the hanger body and the post. The indicator has a top opening and a bottom opening.

The method includes inserting the hook into an admitting end of a discontinuity, moving the hook along the discontinuity to allow the hook to be positioned within the top opening and the bottom opening, manipulating the indicator to engage the indicator with the indicator retaining member, expanding the top opening of the indicator through the engagement between the indicator and the indicator retaining member to position the indicator at the lower neck region, wherein the discontinuity communicates the top opening and the bottom opening and is dimensioned to admit the hook. The method further includes flexing the indicator to partially deform the indicator along the discontinuity of the indicator, disengaging the indicator from the indicator retaining member of the hanger upon the deformation of the indicator and separating the indicator from the hanger.

Preferably, the indicator includes opposite front and rear sidewalls and opposite left and right end walls, which defines a substantially trapezoidal profile of the indicator. Preferably, the discontinuity includes comprises a substantially consistent discontinuity in at least one of the end walls. Preferably, the discontinuity is disposed in at least one of the sidewalls, which includes a lower cutout continuous with the bottom opening of the indicator and an upper slot continuous with the top opening of the indicator. Preferably, the lower cutout is substantially triangular with the apex thereof continuous with the upper slot. Preferably, the indicator can be separated from the hanger by ejecting the indicator from the post of the hanger upon the deformation of the indicator and moving the hook along the discontinuity to discharge the hook from the top opening and the bottom opening.

According to another aspect of the present invention, provided is a combination of a hanger and an indicator removably attachable to the lower neck region of the hanger. The hanger includes a hanger body having a first lateral width, a post extending upward from the body and a hook retained in the post, and at least one indicator retaining member vertically distanced form the hanger body and extending outwardly from the post. The intersection of the post and the hanger body defines a lower neck region of the hanger. The indicator includes a pair of opposite sidewalls connected by a pair of end walls for providing a substantially trapezoidal body of the indicator having four corners and a top opening and a bottom opening at the top end and the bottom end of the indicator, respectively. The at least one indicator retaining member provides indicator retaining interference with the indicator to retain the indicator at the lower neck region.

Preferably, the indicator further comprises a discontinuity communicating the top opening and the bottom opening, the discontinuity being configured to admit the hook of the hanger and assist deformation of the indicator. The discontinuity can be disposed in at least one of the sidewalls or at least one of the end walls. More preferably, the discontinuity includes a slot continuous with the top opening and a cutout continuous with the bottom opening, the cutout being substantially triangular with the apex thereof continuous with the slot. More preferably, the discontinuity includes a substantially consistent slot communicating the top opening and the bottom opening.

Preferably, the indicator further includes a top wall for defining the top opening and the indicator retaining member includes at least a ring at the top of the post, the ring being configured to operatively engage the top wall to retain the indicator at the lower neck region of the hanger.

Preferably, the post is substantially cylindrical having a substantially planar front surface, a substantially planar rear surface and a pair of curved side surfaces connecting the front surface and the rear surface. More preferably, the top opening has a pair of opposite curved sides connected by a pair of opposite straight sides defined in the top wall, the top opening substantially complying with the outer profile of the post such that the ring extends beyond the front surface and the rear surface of the post to provide a front ledge and a rear ledge, respectively, for engaging the top wall of the indicator.

Preferably, the hanger further includes at least one strut angularly disposed between the post and the body, the strut including a bottom end having a second lateral width substantially equal to the first lateral width. More preferably, the indicator further includes at least one elevation disposed on an inner surface of the sidewalls adjacent one of the four corners, and when the indicator is attached to the lower neck region of the hanger, the at least one elevation is positioned against the bottom end of the strut to provide a pivot upon which deformation of the indicator can be actuated.

Preferably, the hanger further includes at least one projection disposed on an outer surface of the post and when the indicator is attached to the lower neck region of the hanger, the at least one projection is positioned against one of the sidewalls of the indicator to provide a pivot upon which deformation of the indicator can be actuated. More preferably, the at least one projection includes at least one substantially half-spherical protrusion disposed on the front surface or the rear surface of the post. More preferably, the at least one projection includes at least one vertically extending rib disposed on a front surface or a rear surface of the post.

Preferably, the hanger body includes a first arm and a second arm extending oppositely to one another.

BRIEF DESCRIPTION OF THE DRAWINGS

These and other features, aspects and benefits of the present invention will be made apparent with reference to the following specification and accompanying drawings, where like reference numerals refer to like features across the several views, and wherein.

DETAILED DESCRIPTION OF THE EMBODIMENTS

Figure 1:
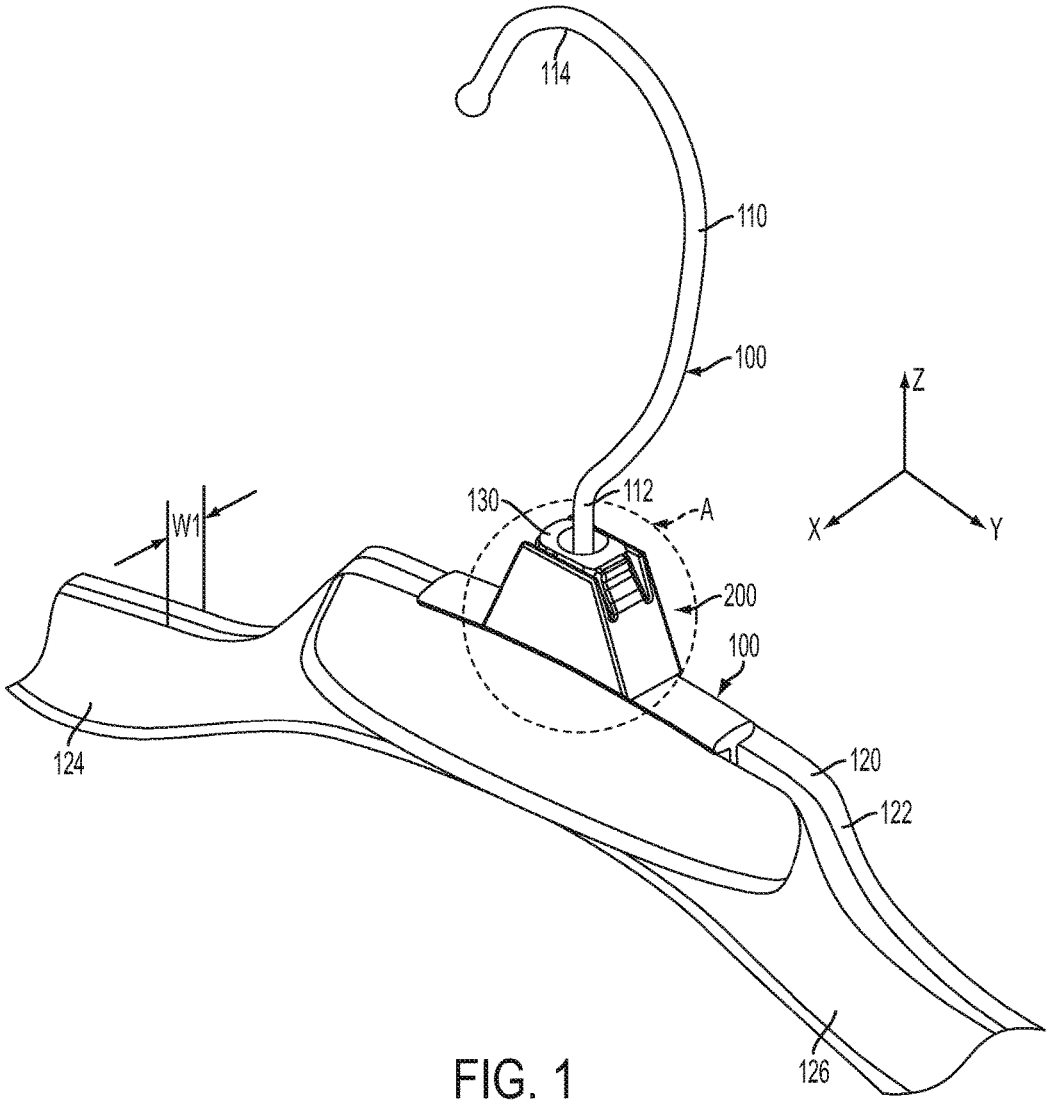
FIG. 1 illustrates a partial cutaway perspective view of a combination of a garment hanger and a reusable lower neck indicator according to an exemplary embodiment of the present invention.

Referring to FIG. 1, illustrated is a combination of a garment hanger 100 and a reusable lower neck indicator 200 securely yet removably attached to the hanger 100 at a lower neck region of the hanger, for showing information related to a garment suspended by the hanger 100, such as the size of the garment. For example, the garment hanger 100 can be a top garment hanger. However, a person of ordinary skill in the art understands that the inventive concept of the present application can be applied to any type of garment hangers, including but not limited to, top garment hangers, pinch grip hangers, knit wear hangers, swim wear hangers, children's hangers, coordinate hangers, and so on.

The hanger 100 includes a hook 110 and a hanger body 120. The hook 110, such as a metal wire hook, is rotatably mated to the body 120. The body 120 is generally planar and has a body flange 122 extending circumferentially around the body. The body 120 further includes a pair of arms 124, 126 extending opposite to one another. At the junction of the hook 110 and the body 120, a substantially cylindrical post 130 extends above the body 120 and the body flange 122. The intersection of the post 130 and the body 120 defines a lower neck region A. The hook 110 includes a substantially vertical part 112 approximate the lower neck region A and a curved portion 114 configured to engage a support structure. The hanger body 120 can have any suitable configuration, such as a C-section beam, a reversed U-section beam, I-section beam and the like.

In FIG. 1, a three-dimensional coordinate system is defined as shown. The vertical part 112 of the hook 110 extends upward from the hanger body 120, substantially along the vertical Z-axis of the coordinate system. The hanger arms 124 and 126 extend substantially along the horizontal Y-axis of the coordinate system to define a length of the hanger body 120. Furthermore, along the lateral X-axis of the coordinate system, a first width W1 of the hanger body 120 is defined as the lateral width of the hanger body flange 122.

Figure 2:
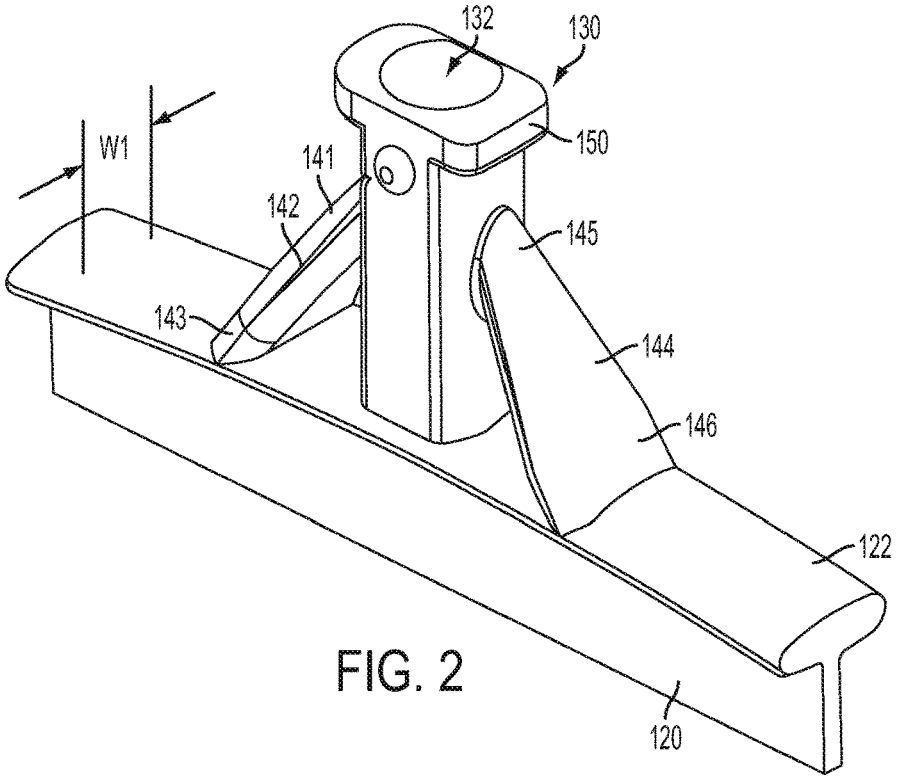
FIG. 2 illustrates a partial cutaway perspective view of the hanger in FIG. 1.

FIG. 2 is a partial perspective of the hanger 100 showing the structure of the post 130. The post 130 has a bore 132 adapted to receive and capture the hook 110, for example, through threaded or frictional engagement. The post 130 can be chamfered at the top of the bore 132, for facilitating the insertion of the hook 110.

The post 130 is supported by a pair of first and second support struts 142 and 144, disposed at either longitudinal side of the post, respectively. The first support strut 142 is angularly disposed between the post 130 and the body flange 122, at the left side of the post 130; the second support strut 144 is angularly disposed between the post 130 and the body flange 122, at the right side of the post 130.

The hanger 100 further includes at least one indicator retaining member. In this embodiment, the indicator retaining member includes a post flange 150 extends outwardly from the left and right sides of the post 130, approximately at the top of the post. The flange 150 can only extend outwardly from one side of the post 130. The flange 150 is vertically distanced from the hanger body flange 122, such that a space is provided between the hanger body flange 122 and the post flange 150 for admitting the reusable lower neck indicator 200. The post flange 150 can be disposed at any suitable vertical position along the height of the post 130, such as at the top of the post 130, as shown in FIGS. 2 and 3.

Figure 3:
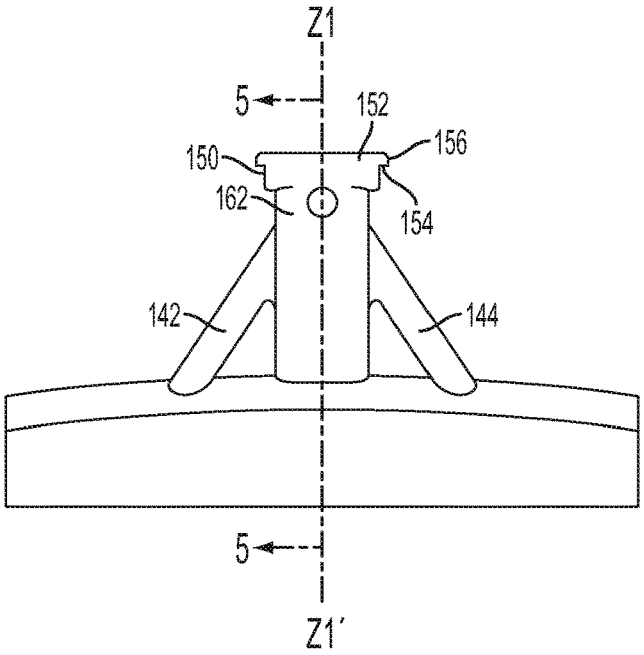
FIG. 3 illustrates a front elevation view of the hanger shown in FIG. 1.

FIG. 3 is a partial front elevation view of the hanger 100 in FIG. 2. The post flange 150 includes a top surface 152, which is substantially aligned with the top surface of the post 130. The post flange 150 further includes a bottom surface 154 and a circumferential side surface 156 connecting the top surface 152 and the bottom surface 154. The post flange 150 provides a step-wise structure for engaging a resilient member of the indicator 200, to allow the indicator 200 to be securely positioned at the lower neck region A under the interference between the bottom surface 154 and the resilient member of the indicator. The post flange 150 can be rounded or curved at the intersection between the top surface 152 and the side surface 156 to allow a smooth engagement between the flange 150 and the indicator and/or at the intersection between the bottom surface 154 and the side surface 156 to facilitate removal of the indicator 200 from the lower neck region A.

Furthermore, the side surface 156 can be adapted to provide various transitions between the top surface 152 and the bottom surface 154. For example, the side surface 156 can be at least partially slanted or can itself be step-wise, defining one or more steps.

Figure 4:
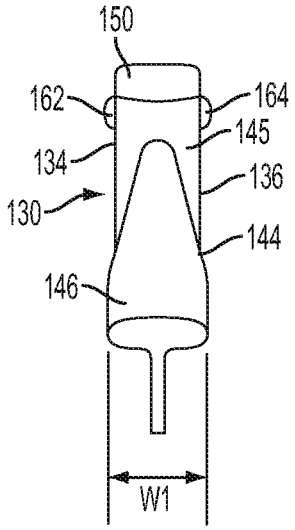
FIG. 4 illustrates a partial right side view of the hanger shown in FIG. 1.
Figure 5:
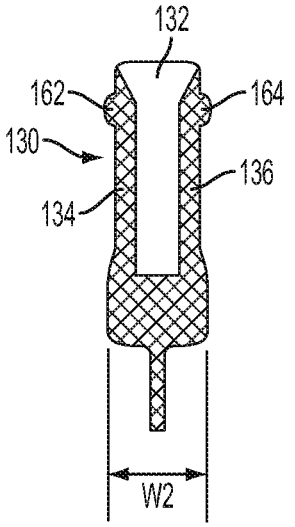
FIG. 5 illustrates a section view of the hanger along lines 5-5 in FIG. 3.

FIG. 4 is a right side view of the hanger and FIG. 5 is a sectional view of the hanger along lines 5-5 in FIG. 3. As shown, the post 130 has a front surface 134 and a laterally opposite rear surface 136, both surfaces being substantially planar in this embodiment. The lateral distance between the front surface 134 and the rear surface 136 can be slightly smaller than the first width W1 of the hanger body.

Furthermore, one ore more projections are disposed on the post 130 to provide one or more pivots for deforming the indicator 200, when the indicator 200 is removed from the lower neck region A of the hanger 100. In this embodiment, a pair of opposite first protrusion 162 and second protrusion 164 are provided. The first protrusion 162 is disposed on the front surface 134 and vertically distanced from the body flange 122. The second protrusion 164 is disposed on the rear surface 136, opposite to the first protrusion 162. The first protrusion 162 and the second protrusion 164 extend outwardly from the front surface 134 and the rear surface 136, respectively. The first and second protrusion 162 and 164 function to provide pivots for twisting, rotating or deforming the reusable lower neck indicator 200, when a user intends to remove the indicator 200 from the hanger 100 for reusing purposes. Additionally, depending on the dimensions of the protrusion, the first and second protrusions 162 and 164 can enhance the structural interference between the post 130 and the indicator 200, thereby achieving a more secure attachment.

In the shown embodiment, the protrusions 162 and 164 are shaped substantially half-spherical. However, any suitable configurations can be applied to the protrusions 162 and 164. For example, the protrusions 162 and 164 can be cone-shaped, cylindrical, pointed-tipped and so on.

The configuration of the first and second support struts 142 and 144 will be described now with reference to FIGS. 2, 4 and 5. Preferably, the first strut 142 and the second strut 144 are structurally symmetrical to each other with respect to longitudinal central axis Z1-Z1'. As shown in FIG. 4, the second strut 144 is generally tapered, with a narrowed top end 145 connected to the side of the post 130 and a large bottom end 146 connected to the body flange 122. The bottom end 146 has a second width W2, as shown in FIG. 5, which is substantially equal to the first width W1 of the body flange 122. Similarly, the first strut 142 is also vertically tapered, including a narrowed top end 141 and an expanded bottom end 143. The bottom end 143 has the same second width W2, which is substantially equal to or slightly larger than the first width W1 of the body flange 122.

The first strut 142 and the second strut 144, both having an expanded bottom end, provide additional pivots for twisting, rotating or deforming the reusable lower neck indicator 200, when a user intends to remove the indicator 200 from the hanger 100. The pivots provided by the first and second protrusion 162 and 164 and the pivots provided by the bottom ends of the first strut 142 and the second strut 144, in concert, allow the reusable lower neck indicator 200 to be partially deformed when a force is applied to the indicator 200 to twist or rotate the indicator, thereby disengaging the resilient member of the indicator 200 from the bottom surface 154 of the post flange 150. Similarly, depending on the dimensions, the first strut 142 and the second strut 144 can provide additional structural interference with the indicator 200.

Figure 8:
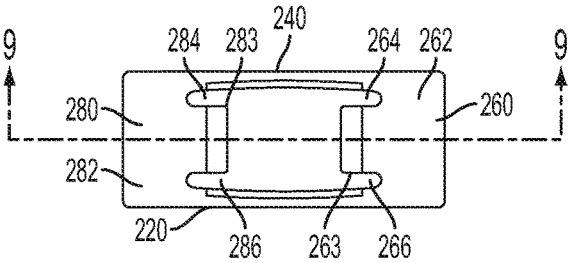
FIG. 8 illustrates a top view of the reusable indicator shown in FIG. 1.
Figure 9:
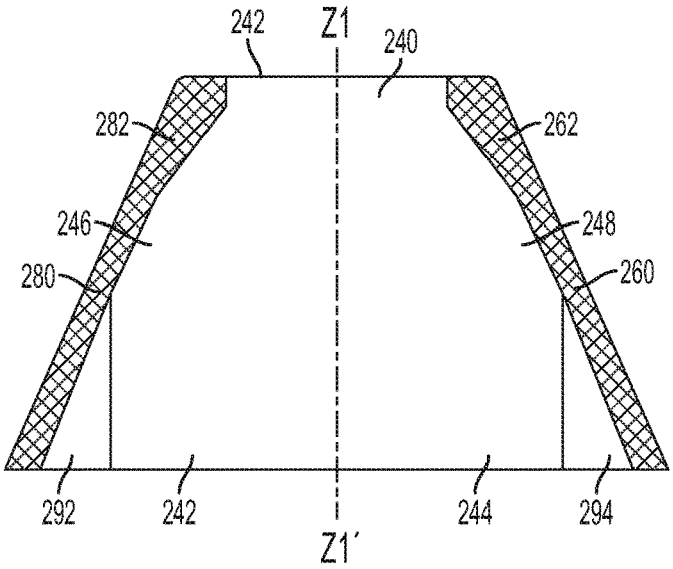
FIG. 9 illustrates a sectional view of the reusable indicator along lines 9-9 in FIG. 8.

FIGS. 6-11 depict the reusable lower neck indicator 200. The indicator 200 includes an indicator body 210, which substantially surrounds the hook 110 and the post 130 when the indicator 200 is attached to the hanger 100 at the lower neck region A. The indicator 200 further includes a top opening 230 and a bottom opening 250, formed at the top end and bottom end of the indicator 200, respectively. During the process of attaching the indicator 200 to the lower neck region A, the indicator 200 passes over the hook 110 and the post 130 through the top opening 230 and the bottom opening 250, and subsequently slides downwardly to sit on the body flange 122 of the hanger body 120. Preferably, the bottom opening 250 is larger than the top opening 230, and the top opening 230 of the indicator 200 is suitably dimensioned to allow the indicator 200 to pass over the post 130 while providing certain interference with the post 130 and/or any peripheral structures of the post, such as the post flange 150. In the shown embodiment, the indicator body 210 includes a pair of opposite sidewalls, namely, an anterior wall 220 and an opposite posterior wall 240. The indictor 210 further includes a pair of opposite end walls, namely, a right end wall 260 and a left end wall 280 connecting the anterior wall 220 and the posterior wall 240, thereby forming a continuous structure for the indicator body 210 to substantially surround the post 130 and the hook 110 of the hanger 100. The anterior wall 220 and the posterior wall 240 are substantially trapezoidal. Accordingly, the indicator body 210 is substantially trapezoidal with four lower corners and four upper corners. The anterior wall 220 and the posterior wall 240 are geometrically equal and symmetrical to one another. The anterior wall 220 includes substantially parallel upper end 222 and lower end 224, and a pair of slanted sides 226 and 228. Symmetrically, the posterior wall 240 includes substantially parallel upper end 242 and lower end 244 and a pair of slanted sides 246 and 248, as shown in FIG. 9. The trapezoidal profile of the indicator 200 provides a visually pleasing displaying area. The upper end 222 of the anterior wall 220 and the upper end 242 of the posterior wall 240 are substantially in the same plane of the top opening 230.

Figure 6:
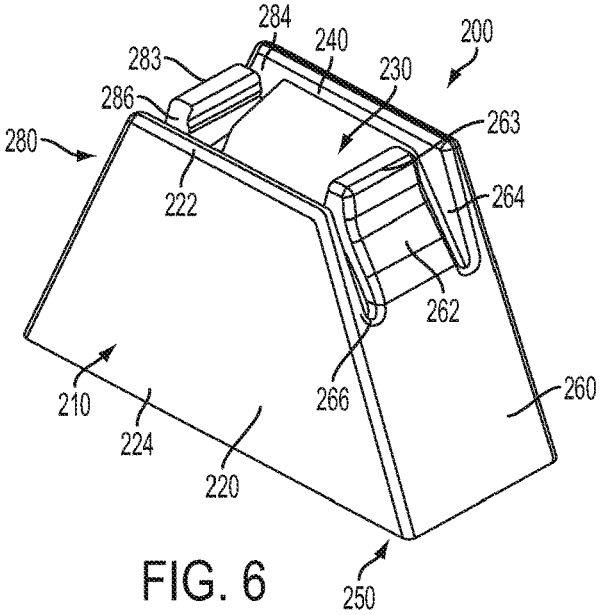
FIG. 6 illustrates a perspective view of the reusable indicator shown in FIG. 1.
Figure 7:
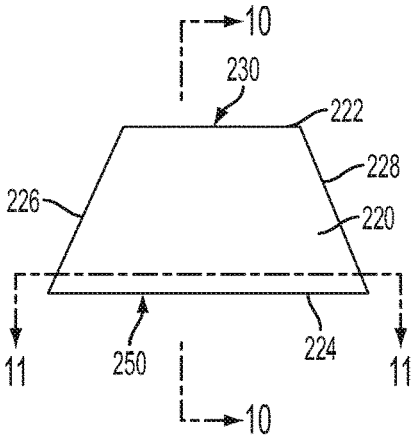
FIG. 7 illustrates a front elevation view of the reusable indicator shown in FIG. 1.
Figure 10:
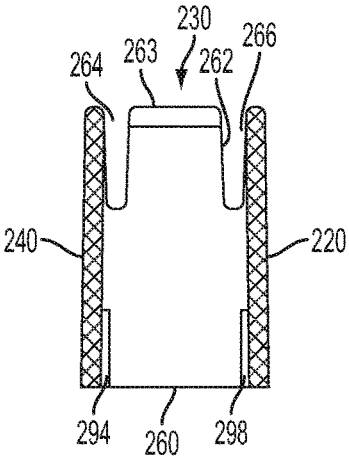
FIG. 10 illustrates a sectional view of the reusable indicator along line 10-10 in FIG. 7.

As shown in FIGS. 6, 8 and 10, the right end wall 260 includes a first resilient tab 262 substantially in a finger-like shape. The first resilient tab 262 terminates in a first free upper end 263, which is substantially in the same plane as the top opening 230 of the indicator 200. The first resilient tab 262 is defined and bounded by a first pair of slots 264 and 266, at the lateral sides of the right end wall 260, respectively. The first pair of slots 264 and 266 are substantially elongated slots parallel to one another, extending downwardly from the plane of the top opening 230 of the indicator. The construction of the first pair of slots 264 and 266 bounding the first resilient tab 262 provides the first resilient tab 262 the ability to deflect outwardly to enlarge the top opening 230 under a biasing force and return inwardly to its original position when the bias force is withdrawn.

The indicator 200 further includes a second resilient tab 282 formed in the left end wall 280 of the indicator. The second resilient tab 282 is opposite to the first resilient tab 262 and substantially symmetrical to the first resilient tab 262. The second resilient tab 282 terminates in a second free upper end 283, which is also substantially in the same plane as the top opening 230 of the indicator 200. The second resilient tab 282 is defined and bounded by a second pair of slots 284 and 286, at the lateral sides of the left end wall 280, respectively. The second pair of slots 284 and 286 are substantially elongated slots parallel to one another, extending downwardly from the plane of the top opening 230 of the indicator 200. Similarly, the construction of the second pair of slots 284 and 286 bounding the second resilient tab 282 provides the second resilient tab 282 the ability to deflect outwardly to further enlarge the top opening 230 under a biasing force and return inwardly to its original position when the bias force is withdrawn.

By deflecting outwardly the first resilient tab 262 and the second resilient tab 282 simultaneously, the top opening 230 of the indicator 200 can be enlarged to allow the indictor to pass over the post 130 and/or and any peripheral structure thereof to allow the indicator 200 to be securely attached to the hanger 100.

Although the above embodiment has been described with respect to a resilient tab formed in an end wall, it is understood by one of ordinary skill in the art that the resilient tab can be formed in a side wall instead of the end wall or in both the side wall and the end wall, depending on specific requirements and application circumstances of the indicator.

During the operation of attaching the indicator 200 to the hanger 100, the indicator 200 first passes over the hook 110 and approaches the post 130 at the lower neck region A of the hanger 100. Subsequently, the first resilient tab 262 and the second resilient finger 282 come into engagement with the post flange 150. The interaction between the resilient tabs and the post flange expands the top opening 230 of the indicator 200 by outwardly deflecting the resilient tab, which allows the indicator 200 to continue moving downwardly until it passes over the post flange 150, particularly, the side surface 156 of the flange.

Preferably, the post flange 150 is rounded, curved or chamfered at the intersection between the top surface 152 and side surface 156 of the flange, thereby providing a smooth profile for flexing the resilient tabs.

Once the resilient tabs passes over the side surface 156 of the flange 150, the tabs return to their original position, due to the resilience of the material for constructing the indicator. Thus, the first resilient tab 262 and the second resilient finger 282 are placed under the bottom surface 154 of the post flange 150. The bottom surface 154, accordingly, provides indicator retaining interference with the resilient tabs of the indicator to retain the indicator at the lower neck region A of the hanger 100.

Figure 11:
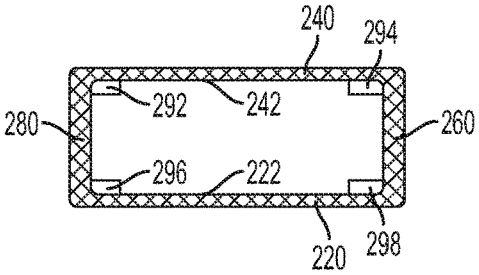
FIG. 11 illustrates a sectional view of the reusable indicator along lines 11-11 in FIG. 7.

FIG. 9 is a cross section view of the reusable lower neck indicator 200 along lines 9-9 of FIG. 8. FIG. 11 is a cross section view of the reusable lower neck indicator 200 along lines 11-11 of FIG. 7. The indicator 200 further includes a plurality of relatively thin elevations disposed on the interior of the indicator, adjacent the four lower corners of the indicator. In the shown embodiment, the indicator 200 includes a pair of first and second elevations 292 and 294 disposed on the inner surface 242 of the posterior wall 240, adjacent rear lower corners of the indicator, and a pair of third and fourth elevations 296 and 298 disposed on the inner surface 222 of the anterior wall 220, adjacent the front lower corners of the indicator. Specifically, the first elevation 292 is disposed at the left lower corner of the posterior wall 240 and is substantially triangular in profile; the second elevation 294 is disposed at the right lower corner of the posterior wall 240 and is also substantially triangular in profile. The first and second elevations 292 and 294 are substantially symmetrical with respect to a vertical central axis Z1-Z1' of the indicator 200. The third and fourth elevations 296 and 298 are substantially the mirror of the first and second elevations 292 and 294. The lower ends of the elevations are substantially aligned with the lower ends of the sidewalls or end walls, such that the elevations do not extend beyond the lower end of the indicator. However, without departing from the invention, the elevations can have different configurations and locations, with respect to each other.

After the indicator 200 has been successfully attached to the lower neck region A of the hanger 100, the first to fourth elevations 292-298 are positioned laterally against the bottom ends 143 and 146 of the first and second support struts 142 and 144, respectively. Particularly, the first elevation 292 is positioned against the front side of the bottom end 143 of the first support strut 142 and the third elevation 296 is positioned against the rear side of the side of the bottom end 143 of the first support strut 142; the second elevation 292 is positioned against the front side of the bottom end 146 of the second support strut 144 and the fourth elevation 298 is positioned against the rear side of the side of the bottom end 146 of the second support strut 144.

In addition, after the indicator 200 has been successfully attached to the lower neck region A of the hanger 100, the first protrusion 162 is positioned laterally against the upper end 222 of the anterior wall 220 and the second protrusion 164 is positioned laterally against the upper end 242 of the posterior wall 240.

The distance between the elevations and the bottom ends of the struts is substantially small, such that when the indicator 200 is twisted or rotated by a force, the deformation of the indicator 200 results in physical contact between the elevations and their corresponding strut ends. Similarly, the distance between the protrusions and the upper ends of the anterior and posterior walls is substantially small, such that when the indicator 200 is twisted or rotated, the deformation of the indicator 200 would result in physical contact between the protrusions and the upper ends of the walls.

The elevations and the protrusions, separately or in concert, function as pivots for additionally twisting, rotating or deforming the indicator 200, which in turn results in displacement of the resilient tabs 262 and 282 against the post flange 150 and the expansion of the top opening 130. Accordingly, the resilient tabs 262 and 282 can be released from the engagement with the post flange 150, thereby removing the indicator 200 from the hanger 100. The removed indicators can be processed, such as, selected, cleaned, sorted and transported, for reuse purposes, according to an indicator-reuse methodology.

Preferably, the elevations 292-298 and the bottom ends 143 and 146 of the struts are configured and dimensioned to allow the elevations to slightly abut against the bottom ends from the front side and rear side of the hanger 100, respectively. For example, the first elevation 292 and the third elevation 296 can abut the bottom end 143 of the first strut 142 from the front side and rear side, respectively, to slightly pinch the bottom end 143 therebetween. Accordingly, the structural interference between the indicator 200 and the hanger 100 is enhanced to achieve a more secure attachment. Similarly, the protrusions 162 and 164 can be configured to allow the upper end 222 of the anterior wall 220 and the upper end 242 of the posterior wall 240 to slightly pinch the post 150, laterally, thereby enhancing the structural interference between the indicator 200 and the hanger 100.

Figure 12:
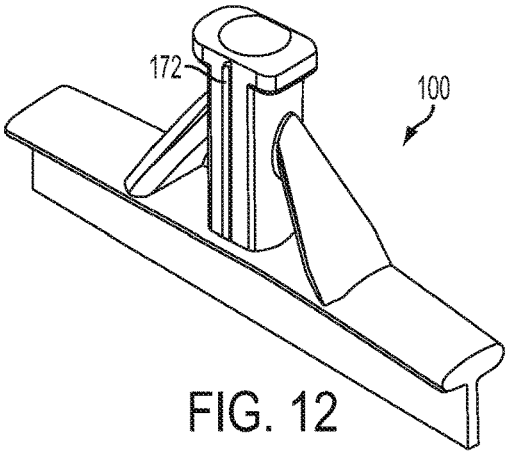
FIG. 12 illustrates a partial cutaway perspective view of a hanger according to another exemplary embodiment of the present invention.
Figure 13:
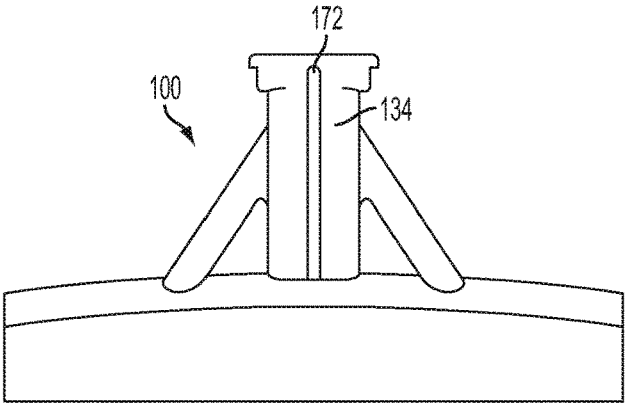
FIG. 13 illustrates a front elevation view of the hanger shown in FIG. 12.
Figure 14:
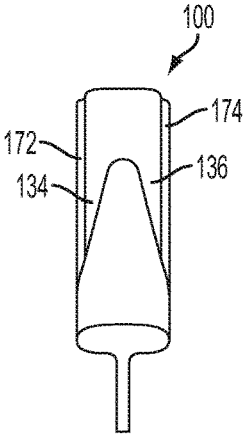
FIG. 14 illustrates a partial right side view of the hanger shown in FIG. 12.

FIGS. 12-14 illustrate another exemplary embodiment of the hanger 100, which includes a first rib 172 disposed on the front surface 134 of the post 130 and a second rib 174 disposed on the rear surface 136 of the post 130. The first rib 172 runs substantially vertically from the top of the post flange 150 to the body flange 122 and extends outwardly from the front surface 134 of the post 130. The second rib 172 runs substantially vertically from the top of the post flange 150 to the body flange 122 and extends outwardly from the rear surface 136 of the post 130.

Similar to the protrusions 162 and 164, the ribs 172 and 174 provide pivots for twisting, rotating or deforming the indicator 200 during the removal of the indicator. The ribs 172 and 174 can also optionally provide structural interference with the indicator 200 to more securely attach the indicator to the hanger 100.

Figure 15:
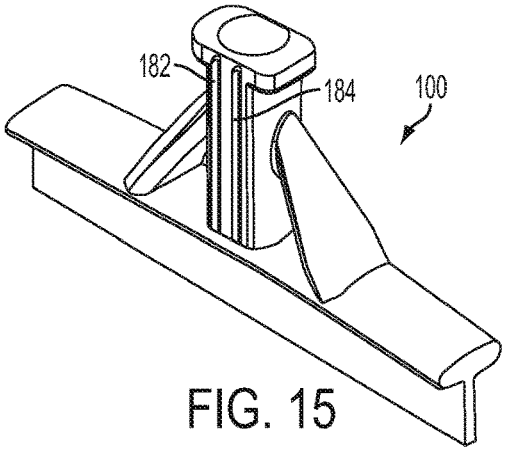
FIG. 15 illustrates a partial cutaway perspective view of a hanger according to still another exemplary embodiment of the present invention.
Figure 16:
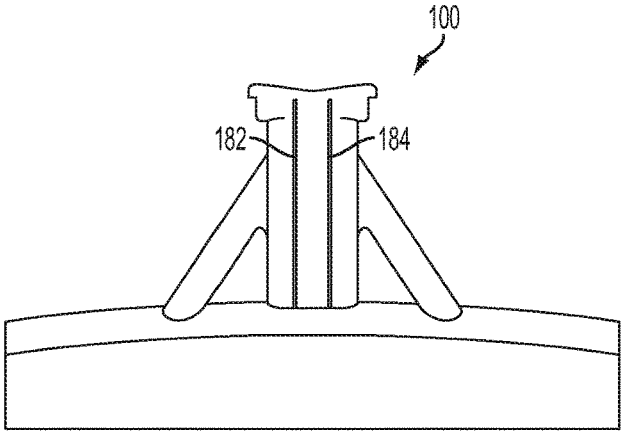
FIG. 16 illustrates a front elevation view of the hanger shown in FIG. 15.
Figure 17:
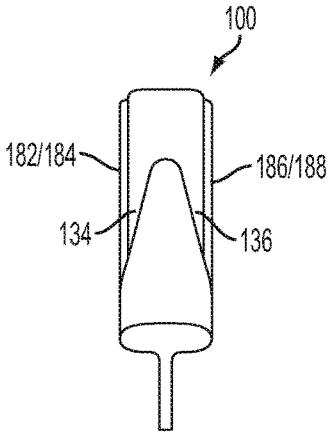
FIG. 17 illustrates a right side view of the hanger shown in FIG. 15.

FIGS. 15-17 illustrate further another exemplary embodiment of the hanger 100, which includes a first pair of ribs 182 and 184 disposed on the front surface 134 of the post 130 and a second pair of ribs 186 and 188 disposed on the rear surface 136 of the post 130. The first pair of ribs 182 and 184 run substantially vertically from the post flange 150 to the body flange 122 and extends outwardly from the front surface 134 of the post 130. The second pair of ribs 186 and 188 run substantially vertically from the post flange 150 to the body flange 122 and extends outwardly from the rear surface 136 of the post 130.

The ribs 182-188 provide pivots for twisting, rotating or deforming the indicator 200 during the removal of the indicator and optional structural interference with the indicator 200 to more securely attach the indicator to the hanger 100.

A person of ordinary skill in the art understands that more than one rib (or one pair of ribs) can be provided on either the front surface or the rear surface of the post. Furthermore, the ribs can be used in combination with the protrusions in the previous embodiment. For example, a protrusion can be disposed on the front surface and a rib (or a pair of ribs) can be disposed on the rear surface. In addition, although the at least one projection has been described with reference to a protrusion (such as the protrusion 162) and a rib (such as the rib 172 or 182), it should be understood that the projection can be of any suitable shape, form or profile as long as the projection is capable of providing a pivot for flexing the lower neck indicator.

Associated with the hanger 100 and the indicator 200 and according to another aspect of the present invention, a method for removing an indicator from a hanger is provided. The hanger includes a hanger body, a post extending upwardly from the hanger body and an indicator retaining member associated with the post for engaging the indicator to position the indicator at a lower neck region of the hanger.

The removing method includes resilient flexing the indicator with respect to at least one pivot to disengage the indicator from the indicator retaining member and separating the indicator from the hanger. The step of flexing includes twisting the indicator with respect to the pivot in a plane substantially perpendicular to the post.

The pivot is provided on the hanger, upon which the indicator is capable of being resiliently flexed. For example, the pivot can be an expanded bottom end of a support strut (such as, the expanded bottom end 143 and 146 of the strut 142 and 144), the expanded end having a lateral width substantially equal to a lateral width of the hanger body. The pivot can be at least one elevation disposed on an inner surface of the sidewalls, which faces the expanded bottom end of the strut when the indicator is positioned at the lower neck region. The pivot can be a projection on a surface of the post. The projection can be a substantially semi-spherical protrusion (such as, the protrusions 162 and 164) provided on the surface at a location adjacent the top of the post or a rib (such as, the rib 172) vertically extending between the top of the post and the hanger body.

Associated with the hanger 100 and the indicator 200 and according to another aspect of the present invention, a method for manipulating a garment hanger and an indicator mountable to a lower neck region of a garment hanger is provided. The hanger includes a hanger body, a post extending upwardly from the hanger body for receiving a hanger hook therein and an indicator retaining member associated with the post for engaging the indicator, the intersection of the hanger body and the post defining the lower neck region of the hanger. The method includes feeding the indicator over the hook of the hanger, sliding the indicator downwardly along the hook to approach the indicator retaining member, engaging the indicator with the indicator retaining member to resilient expand a top opening of the indicator and hanger to allow the indicator to pass over the indicator retaining structure, and positioning the indicator at the lower neck region.

The manipulating method further includes resiliently flexing the indicator with respect to at least one pivot to disengage the indicator from the indicator retaining member and separating the indicator from the hanger, wherein the pivot is provided on the hanger upon which the indicator is capable of being resiliently flexed. The pivot can include an expanded bottom end of a strut disposed angularly between the hanger body and the post, the expanded end having a lateral width substantially equal to a lateral width of the hanger body. The pivot can include at least one elevation disposed on an inner surface of the sidewalls, which faces the expanded bottom end of the strut when the indicator is positioned at the lower neck region. The pivot can include at least one projection on a surface of the post. The projection can be a substantially semi-spherical protrusion on a front surface of the post at a location adjacent the top of the post or a rib extending between a top of the post and the hanger body. Preferably, the step of flexing includes twisting the indicator with respect to the pivot in a plane substantially perpendicular to the post.

The method of removing an indicator from a hanger and the method of manipulating an indicator and a hanger, as described above, can be implemented manually by a user with his/her fingers, or manually by a user with a special tool. Alternatively, these methods can be implemented automatically by a specially designed machine to achieve high efficiency for handling hangers and indicators.

Figure 18:
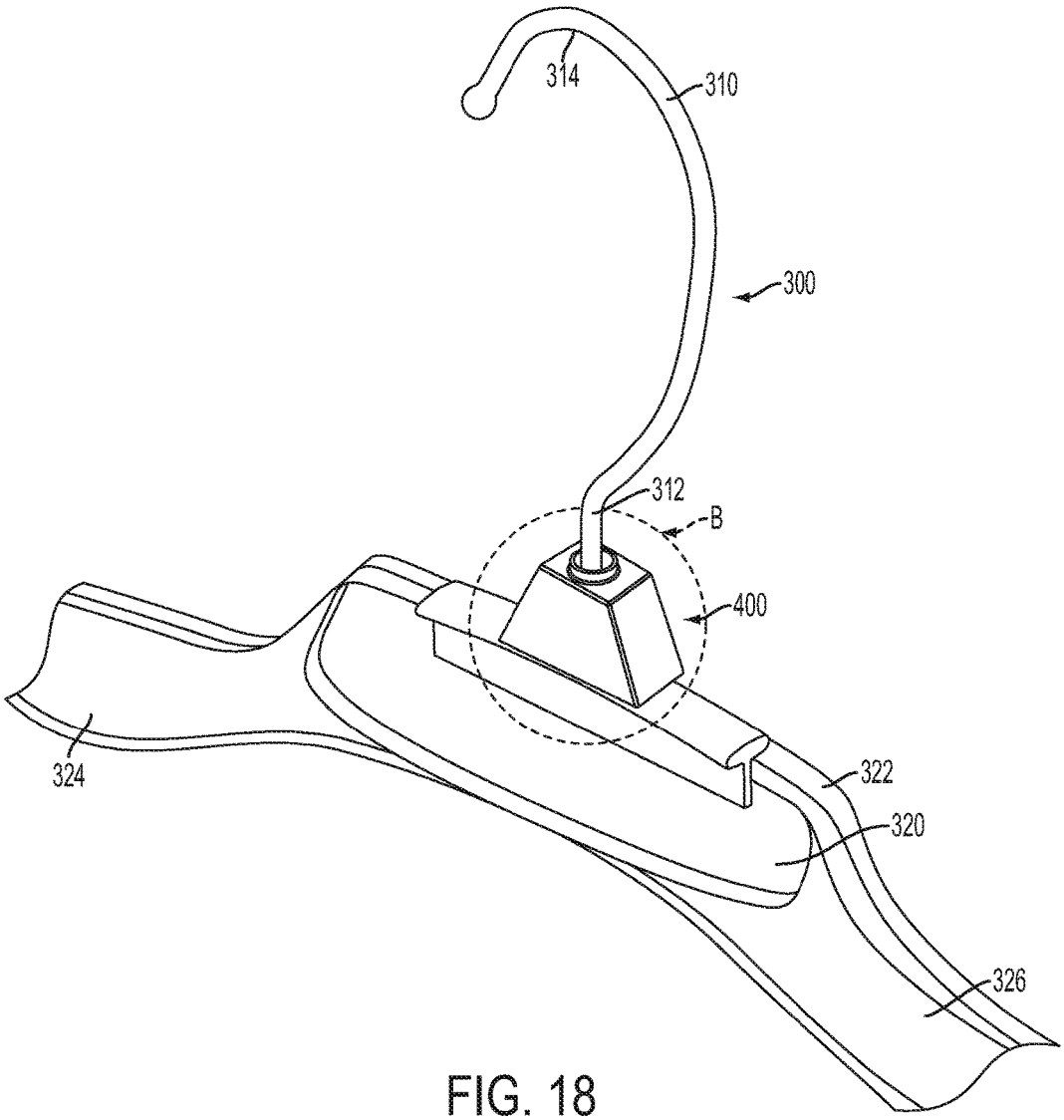
FIG. 18 illustrates a partial cutaway perspective view of a combination of a garment hanger and a reusable lower neck indicator according to another exemplary embodiment of the present invention.

FIG. 18 is a perspective view illustrating a combination of a garment hanger 300 and a reusable lower neck indicator 400 securely yet removably attached to the hanger 300 at a lower neck region of the hanger, for showing information related to a garment suspended by the hanger 300, such as the size of the garment.

The hanger 300 includes a hook 310 and a hanger body 320. The hook 310, such as a metal wire hook, is rotatably mated to the body 320. The body 320 is generally planar and has a body flange 322 extending circumferentially around the body. The body 320 further includes a pair of arms 324, 326 extending opposite to one another for supporting a garment. The hanger body 120 can have any suitable configuration, such as a C-section beam, a reversed U-section beam, I-section beam and so on.

Figure 19:
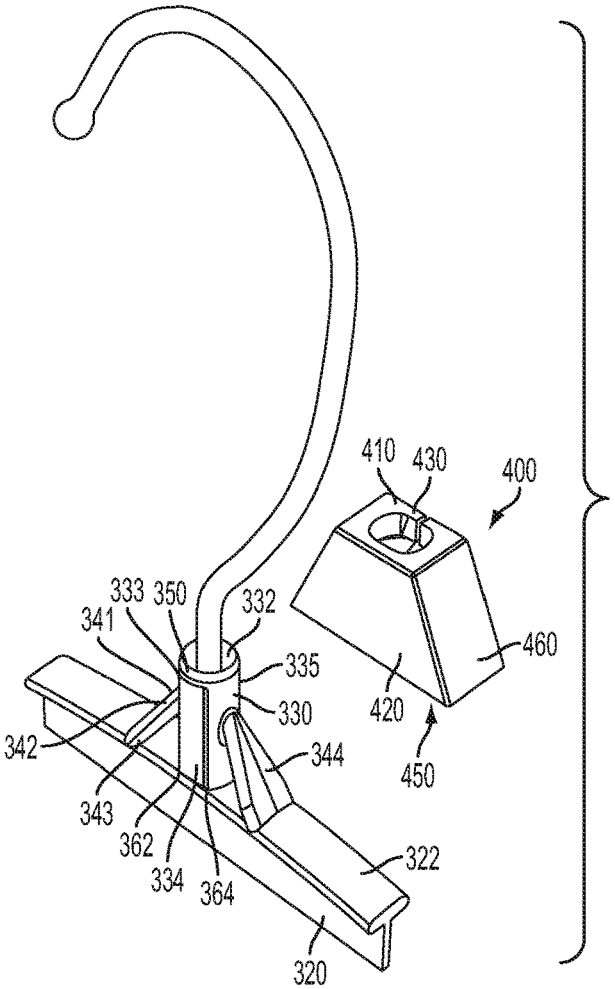
FIG. 19 illustrates a partial cutaway perspective view of the hanger and the indicator shown in FIG. 18.
Figure 20:
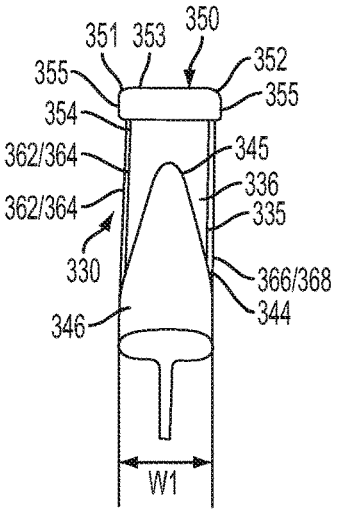
FIG. 20 illustrates a partial right side view of the hanger shown in FIG. 18.
Figure 21:
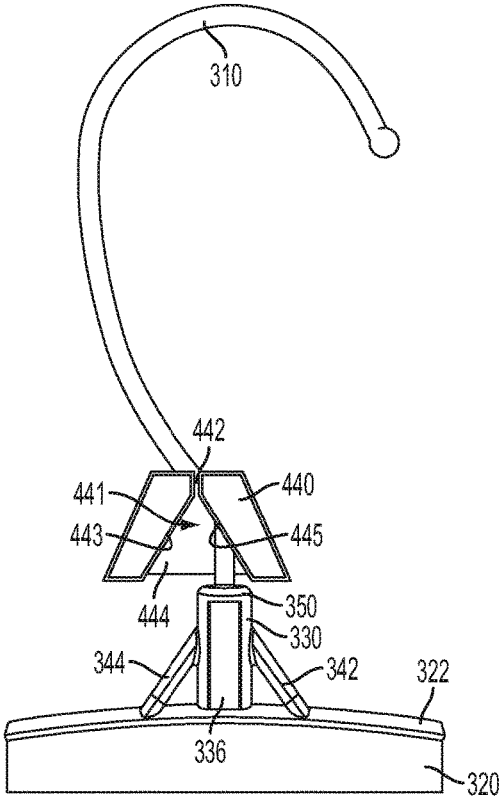
FIG. 21 illustrates a partial rear elevation view of the hanger and the indicator shown in FIG. 18.
Figure 22:
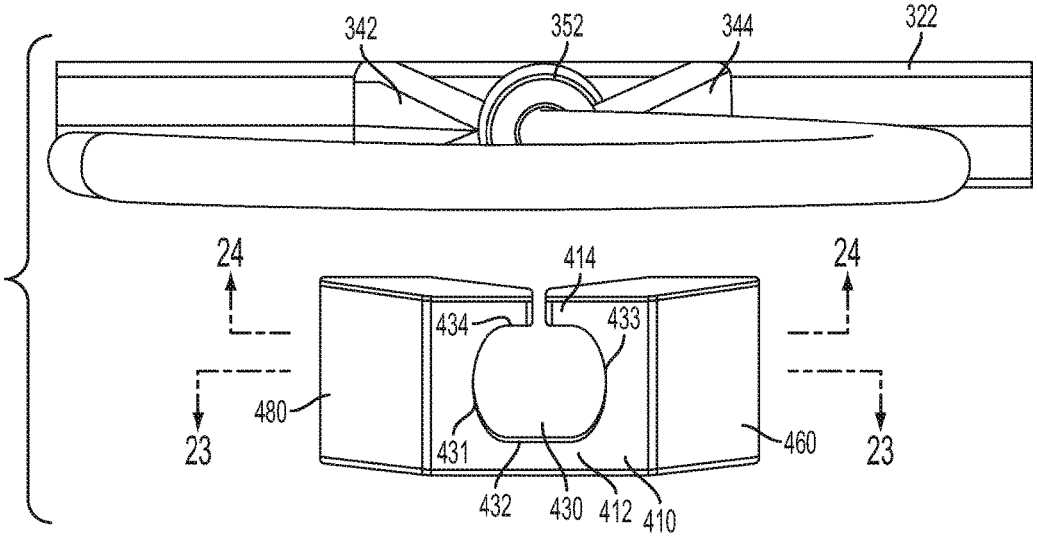
FIG. 22 illustrates a top view of the hanger and the indicator shown in FIG. 18.

FIG. 19 is a partial perspective of the hanger 300 and the reusable lower neck indicator 400. FIG. 20 is a right side view of the hanger 300. FIG. 21 is rear elevation view of the hanger 300 and the reusable lower neck indicator 400. FIG. 22 is a top view of the hanger 300 and the reusable lower neck indicator 400. The structure, function and operation of the hanger 300 and the indicator 400 will be described with reference to FIGS. 19-22.

At the junction of the hook 110 and the body 120, a substantially cylindrical post 330 extends above the body 320 and the body flange 322. The intersection of the post 330 and the body 320 defines a lower neck region B. The hook 310 includes a substantially vertical part 312 approximate the lower neck region B and a curved portion 314 configured to engage a support structure, as shown in FIG. 18.

The post 330 has a bore 332 adapted to receive and capture the hook 110, for example, through threaded or frictional engagement. The post 130 can be chamfered at the top of the bore 332, for facilitating the insertion of the hook 110. The post 330 is supported by a pair of first and second support struts 342 and 344, disposed at either longitudinal side of the post, respectively. The first support strut 342 is angularly disposed between the post 330 and the body flange 322, at the left side of the post 330; the second support strut 344 is angularly disposed between the post 330 and the body flange 322, at the right side of the post 330.

The post 330 has a round left surface 333 and a longitudinally opposite right surface 335. The post 330 further has a front surface 334 and an opposite rear surface 336, both surfaces being substantially planar in this embodiment. These surfaces together define the outer profile of the substantially cylindrical post 330.

In this embodiment, the indicator retaining member includes a ring 350 disposed substantially at the top of the post 330. The ring 350 is substantially concentric with the post 330. The front end 351 and the rear end 352 of the ring 350 extend laterally beyond the planar front surface 334 and the rear surface 336, respectively. The front end 351 and the rear end 352 of the ring 350 provide a front ledge and a rear ledge, respectively, for engaging the indicator 400. Specifically, the ring 500 is vertically distanced from the hanger body flange 322, such that a space is provided between the hanger body flange 322 and the ring 550 for admitting the reusable lower neck indicator 400. The ring 350 can be disposed at any suitable vertical position along the height of the post 330, such as at the top of the post 330, as shown in this embodiment.

The ring 350 includes a top surface 353, a bottom surface 354 and a substantially round side surface 355 connecting the top surface 353 and the bottom surface 354. The side surface 355 can be chamfered or rounded at its intersection with the top surface 353, to allow a smooth engagement between the ring 350 and the indicator 400. The side surface 355 can also be chamfered or rounded at its intersection with the bottom surface 354, to facilitate removal of the indicator 400.

Furthermore, the side surface 355 can be adapted to provide various transitions between the top surface 353 and the bottom surface 354. For example, the side surface 355 can be at least partially slanted or can itself be step-wise, defining one or more steps.

The first strut 342 and the second strut 344 are structurally symmetrical to each other. The first strut 342 is generally tapered, including a narrowed top end 341 and an expanded bottom end 343; the second strut 344 is also generally tapered, including a narrowed top end 345 and an expanded bottom end 346. The bottom ends of the struts have a width substantially equal to that of the hanger body flange 322. Similar to the struts in the previous embodiment, the struts 342 and 344, having an expanded bottom end, provide pivots for twisting, rotating or deforming the reusable lower neck indicator 400, when a user intends to remove the indicator 400 from the hanger 300 and reuse the removed indicator. Additionally, the first strut 342 and the second strut 344 can provide additional structural interference with the indicator 400, thereby achieving a more secured attachment.

The post 330 further includes a first pair of ribs 362 and 364 disposed on the front surface 334 of the post 330 and a second pair of ribs 366 and 368 disposed on the rear surface 336 of the post 330. The first pair of ribs 362 and 364 run substantially vertically from the ring 350 to the body flange 322 and extends outwardly from the front surface 334 of the post 330. The second pair of ribs 366 and 368 run substantially vertically from the ring 350 to the body flange 322 and extends outwardly from the rear surface 336 of the post 330.

The ribs 362-368 provide additional pivots for twisting, rotating or deforming the reusable lower neck indicator 400, and can optionally provide additional structural interference with the indicator 400 to achieve a more fixed attachment.

Now referring to FIGS. 19 and 21-24, the structure of the reusable lower neck indicator 400 will be described, which is similar to that of the indicator 200. The reusable lower neck indicator 400 includes a pair of opposite sidewalls, namely, an anterior wall 420 and a posterior wall 440. The reusable lower neck indicator 400 further includes a pair of opposite end walls, namely, a right end wall 460 and a left end wall 480. The end walls and the sidewalls are connected to each other to form a generally trapezoidal indicator body having four lower corners and four upper corners. The indicator 400 further includes a top wall 410, which connects the top ends of the anterior wall 420, the posterior wall 440, the right end wall 460 and the left end wall 480. The top wall 410 defines a top opening 430. The indicator 400 further has a bottom opening 450, which is defined collectively by the bottom ends of the anterior wall 420, the posterior wall 440, the right end wall 460 and the left end wall 480.

The indicator 400 includes a discontinuity 441 traversing the height of the indicator to facilitate attaching the indicator 400 to the hanger 300 and removing the indicator 400 from the hanger. The discontinuity 441 communicates the top opening 430 and the bottom opening 450, such that a continuous path or passageway is provided between the top opening and the bottom opening. The discontinuity 441 extends along the posterior wall 440, which includes a slot 442 and a substantially triangle cutout 444 continuous with the slot 442. The slot 442 laterally extends through the thickness of the posterior wall 440 to be continuous with the top opening 430. The cutout 444 extends from the slot 442 to the lower end of the posterior wall 440, with the apex of the triangular cutout continuous with the slot 442. The cutout 444 is defined by a first edge 443 and a second edge 445 of the posterior wall 440. The slot 442 and the cutout 444, collectively, provide a path for admitting the hook 310 to the top opening 430 and the bottom opening 450, as shown in FIG. 21.

During operation, a user manipulates the hook 310 and the indicator 400 to allow the hook 310 to approximate the slot 442 along the cutout 444. The hook 310 is subsequently pushed against the slot 442 to enter the top opening 430. The slot 442 needs to be only as wide as necessary to allow the indicator 400 to admit the hook 310. For example, the slot 442 can be dimensioned to be slightly narrower than a size of the hook 310 (for example, the diameter of the hook), such that a force is needed to resilient expand the slot 442 to admit the hook 310. Once the hook 310 passes the slot 442, the posterior wall 440 returns to its original position prior to flexing, which can provide an acoustic feedback indicating that the hook 310 has entered the top opening 430.

The top opening 430 has two opposite curved sides 431 and 433, which substantially comply with the left surface 333 and right surface 335 of the post 330, respectively and are connected by two opposite straight sides 432 and 434. The straight sides 432 and 434 define a front platform 412 and a rear platform 414 of the top wall 410, respectively, which during operation engage the front end 351 and the rear end 352 of the ring 350 of the post 330. The top opening can be of any suitable shape, such as circular, for engaging the ring 350.

After the indicator 400 has been admitted in the top opening 430, the user moves the indicator further downwardly. Subsequently, the ring 350 of the post 330 contacts and engages the top wall 410 from beneath. The indicator 400 is further pushed down to resiliently expand the top opening 430 of the top wall 410. Specifically, the front end 351 and the rear end 352 of the ring 350 engage the front platform 412 and the rear platform 414 of the top wall 410 from beneath, respectively. Such engagement expands the top opening 430 to allow the ring 350 to pass over the top wall 410. Subsequently, the front platform 412 and the rear platform 414 of the top wall 410 return to their original position to be placed under the ring 350. The structural interference between the front end 351 and the front platform 412 and the structural interference between the rear end 352 and the rear platform 414 prevent the indicator 400 from being accidentally and inadvertently removed from the hanger 300.

Figure 23:
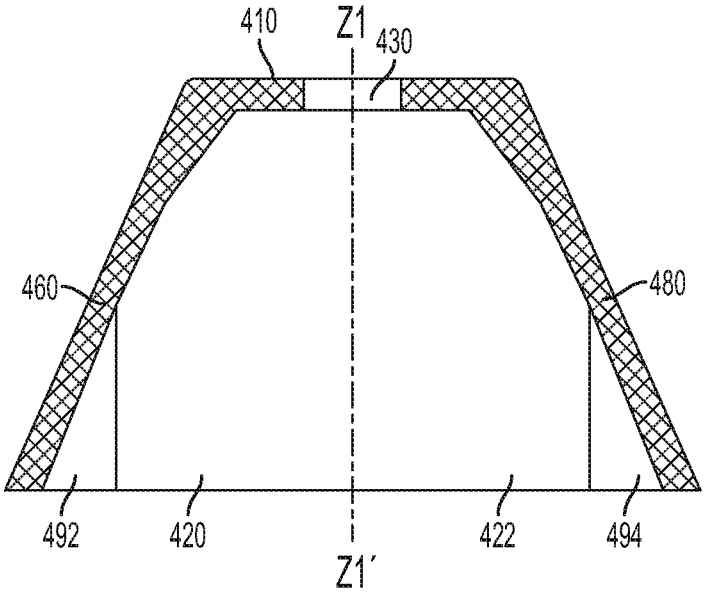
FIG. 23 illustrates a sectional view of the indicator along lines 23-23 in FIG. 22.
Figure 24:
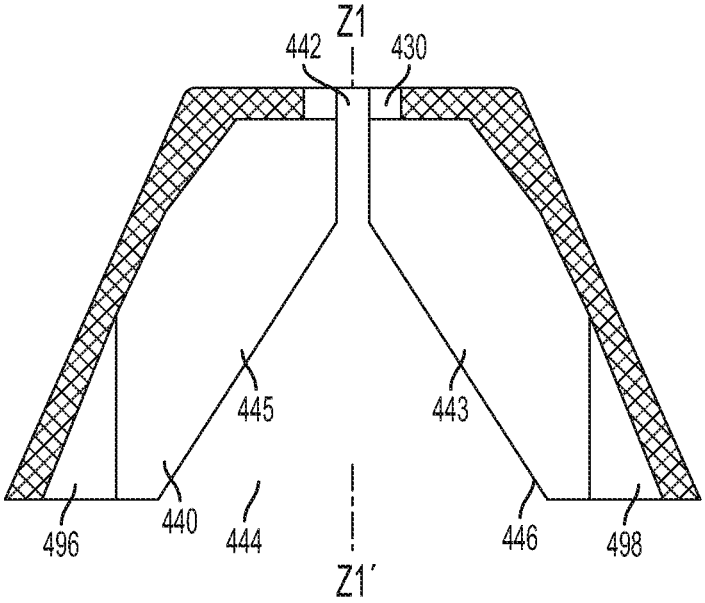
FIG. 24 illustrates a sectional view of the indicator along lines 24-24 in FIG. 22.

FIGS. 23 and 24 are sectional views of the reusable lower neck indicator 400. As shown, the indicator 400 optionally includes a pair of first and second elevations 492 and 494 disposed on the inner surface 422 of anterior wall 420, adjacent the front lower corners of the indicator. The indicator 400 further includes a pair of third and fourth elevations 496 and 498 disposed on the inner surface 446 of posterior wall 440, adjacent the rear lower corners of the indicator. The lower ends of the elevations are substantially aligned with the lower ends of the sidewalls or end walls, such that the elevations do not extend beyond the lower end of the indicator.

After the indicator 400 is successfully attached to the lower neck region B of the hanger 300, the first to fourth elevations 492-498 are positioned laterally against the bottom ends 343 and 346 of the first and second support struts 342 and 344, respectively. Similar to the struts in the previous embodiment, the struts 342 and 344, having an expanded bottom end, provide pivots for twisting, rotating or deforming the reusable lower neck indicator 400, when a user intends to remove the indicator 400 from the hanger 300 and reuse the removed indicator. Optionally, the first strut 342 and the second strut 344 can be dimensioned to provide additional structural interference with the indicator 400, thereby achieving a more fixed attachment.

Figure 25:
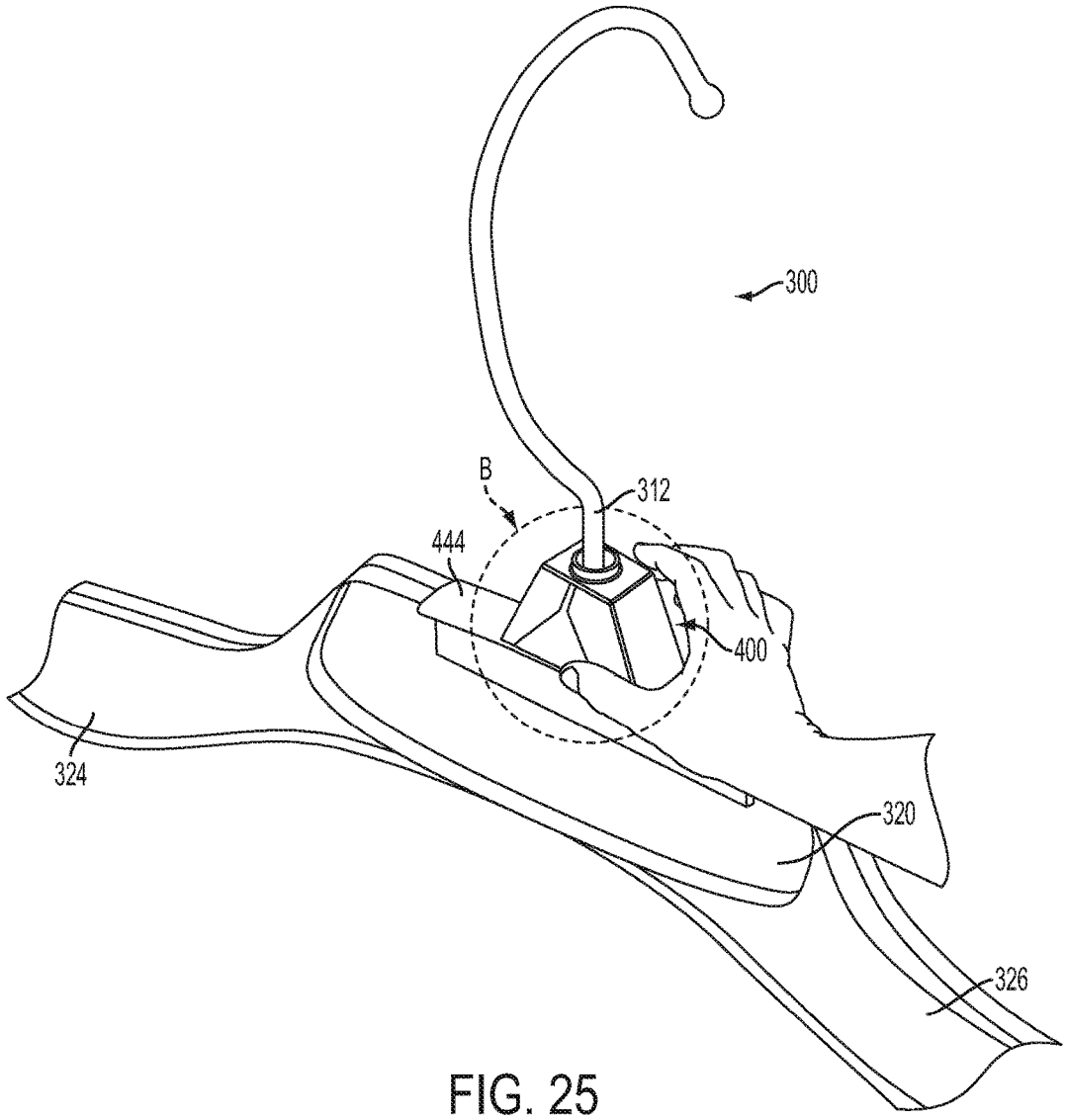
FIG. 25 is a schematic view showing how to remove the indicator from the hanger shown in FIG. 18.
Figure 26:
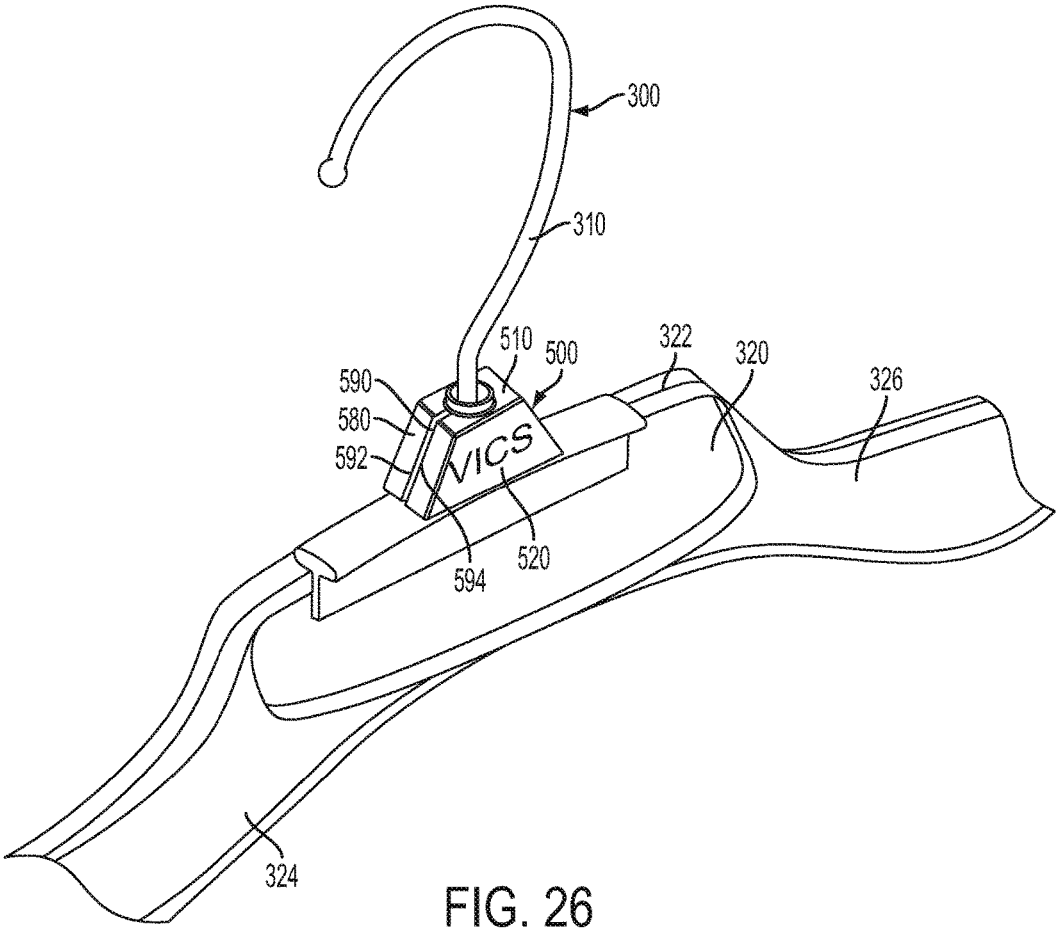
FIG. 26 illustrates a partial cutaway perspective view of a combination of a garment hanger and a reusable lower neck indicator according to yet another exemplary embodiment of the present invention.
Figure 27:
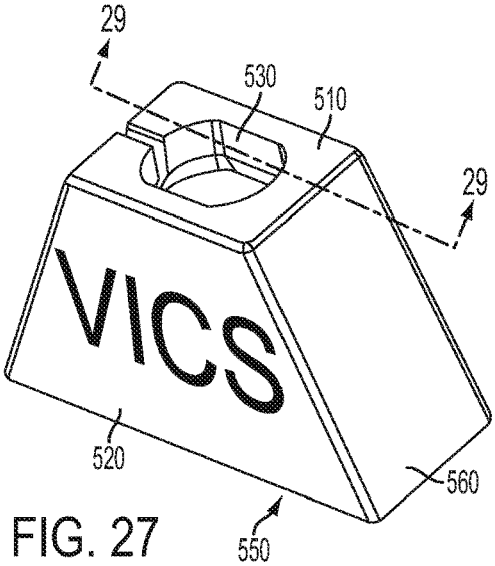
FIG. 27 illustrates a perspective view of the indicator shown in FIG. 26.
Figure 28:
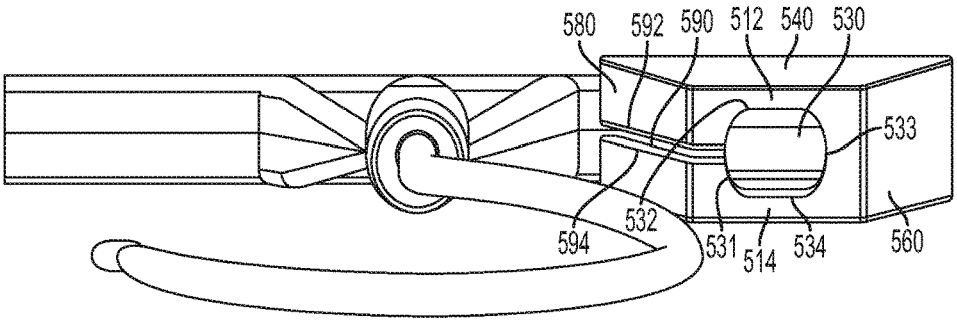
FIG. 28 illustrates a top view of the hanger and the indicator shown in FIG. 26.

FIG. 25 is a schematic view showing how to remove the indicator 400 from the hanger 300 for the purpose of reusing the indicator. To remove the indicator 400, a user simply needs to put one of his/her fingers, for example, a thumb, under the cutout 444 and apply a force against either the first edge 443 or the second edge 445 of the posterior wall 440 to slightly flex the indicator 400 outwardly. The resilient deformation of the indicator 400 would result in temporary expansion of the top opening 430, which in turn allow the front platform 412 and the rear platform 414 of the top wall 410 pass over the front end 351 and the rear end 352 of the ring 350. Consequently, the indicator 400 is removed from the lower neck region B of the hanger 300. The removed indicators can be processed, such as selected, cleaned, sorted and transported, for reuse purposes, according to a reuse methodology.

A person of ordinary skill in the art understands that the discontinuity (such as the combination of the slot and the cutout) can be provided in any suitable wall of the indicator and the profile of the discontinuity can be varied without departing from the invention. For example, the discontinuity can be provided in the anterior wall, the posterior wall and/or any of the end walls of the indicator.

FIGS. 26-29 depict another exemplary embodiment of the reusable lower neck indicator, identified by 500. The indicator 500 can be fixedly attached to the lower neck region B of the hanger 300; yet can be removed from the lower neck region for reuse purposes.

The indicator 500 includes a pair of opposite sidewalls, namely, an anterior wall 520 and a posterior wall 540. The indictor 500 further includes a pair of opposite end walls, namely, a right end wall 560 and a left end wall 580. The sidewalls and the end walls are connected form a generally trapezoidal indicator body having four lower corners and four upper corners. The indicator 500 further includes a top wall 510, which connects the top ends of the anterior wall 520, the posterior wall 540, the right end wall 560 and the left end wall 580. The top wall 510 defines a top opening 530. The indicator 500 further has a bottom opening 550, which is defined collectively by the bottom ends of the anterior wall 520, the posterior wall 540, the right end wall 560 and the left end wall 580.

The top opening 530 has two opposite curved sides 531 and 533, which substantially comply with the left surface 333 and right surface 335 of the post 330, respectively and are connected two opposite straight sides 532 and 534. The straight sides 532 and 534 define a front platform 512 and a rear platform 514 of the top well 510, respectively, for engaging the front end 351 and the rear end 352 of the ring 350 of the post 330. The top opening can be of any suitable shape, such as circular, for engaging the ring 350.

The lower neck indicator 500 includes a discontinuity 590 traversing the height of the indicator to facilitate attaching the indicator 500 to the hanger 300 by admitting the hook 310. The discontinuity 590 further facilitates removing the indicator 500 from the hanger 300 by assisting deformation of the indicator. The discontinuity 590 is configured to communicate the top opening 530 and the bottom 550 of the indicator, thereby providing a continuous path along which the hook 310 can slide to enter the top opening 530. The discontinuity 590 is defined by a first edge 592 and an opposite second edge 594 extending from the lower end of the right end wall 580 to the top wall 510. The discontinuity 590 needs to be only as wide as necessary to allow the indicator 500 to admit the hook 310. For example, the discontinuity 590 can be slightly narrower than the hook 310 where the material selected for the indicator 500 can elastically deform to admit the hook 310. The ends of discontinuity 590 can be curved or chamfered to ease the insertion of the hook 310.

Figure 29:
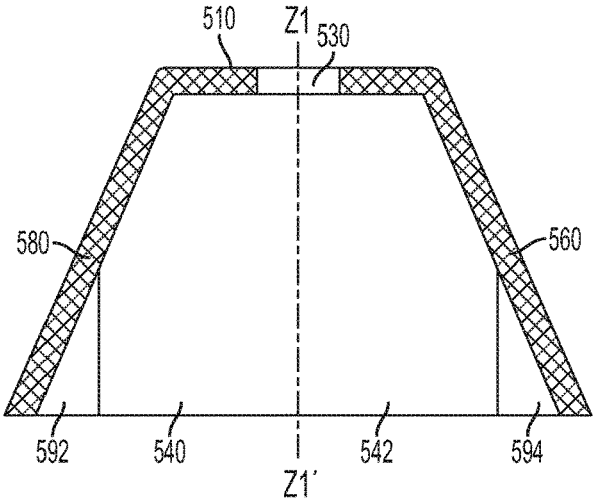
FIG. 29 illustrates a sectional view of the indicator along lines 29-29 in FIG. 27.

As shown in FIG. 29, the indicator 400 includes a pair of first and second elevations 592 and 594 disposed on the inner surface 542 of posterior wall 540, adjacent the rear lower corners of the indicator. The indicator 500 further includes a pair of third and fourth elevations 596 and 598 disposed on the inner surface of anterior wall 520, adjacent the front lower corners of the indicator. These elevations cooperate with the bottom ends 343 and 346 of the first and second support struts 342 and 344, respectively, to provide pivots for twisting, rotating or deforming the reusable lower neck indicator 500, when a user intends to remove the indicator 500 from the hanger 300 and reuse the removed indicator. Optionally, these elevations can be dimensioned to provide additionally structural interference with the bottom ends of the struts. The lower ends of the elevations are substantially aligned with the lower ends of the sidewalls or end walls, such that the elevations do not extend beyond the lower end of the indicator.

Figure 30:
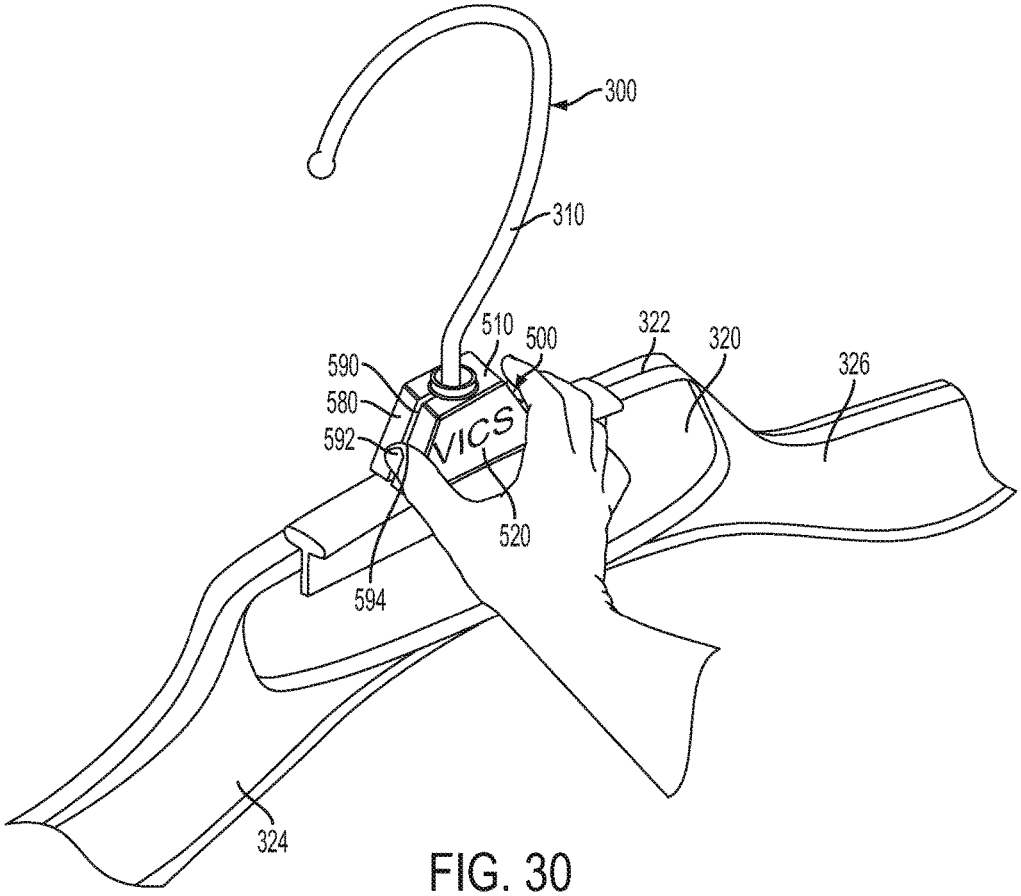
FIG. 30 is a schematic view showing how to remove the indicator from the hanger shown in FIG. 26.

FIG. 30 is a schematic view showing how to remove the indicator 500 from the hanger 300 for the purpose of reusing the indicator. To remove the indicator, a user simply needs to put one of his/her fingers, for example, a thumb, toward the discontinuity 590 and apply a force against the first edge 592 and/or the second edge 594 to slightly flex the indicator outwardly. The resilient deformation of the indicator would result in temporary expansion of the top opening 530, which in turn allow the front platform 512 and the rear platform 514 of the top wall 510 pass over the front end 351 and the rear end 352 of the ring 350. Consequently, the indicator 500 is removed from the lower neck region B of the hanger 300. The removed indicators can be processed, such as selected, cleaned, sorted and transported, for reuse purposes, according to a reuse methodology.

A person of ordinary skill in the art understands that the discontinuity can be provided on the anterior wall, posterior wall and/or an end wall of the indicator and the profile of the discontinuity can be varied without departing from the invention.

Figure 31:
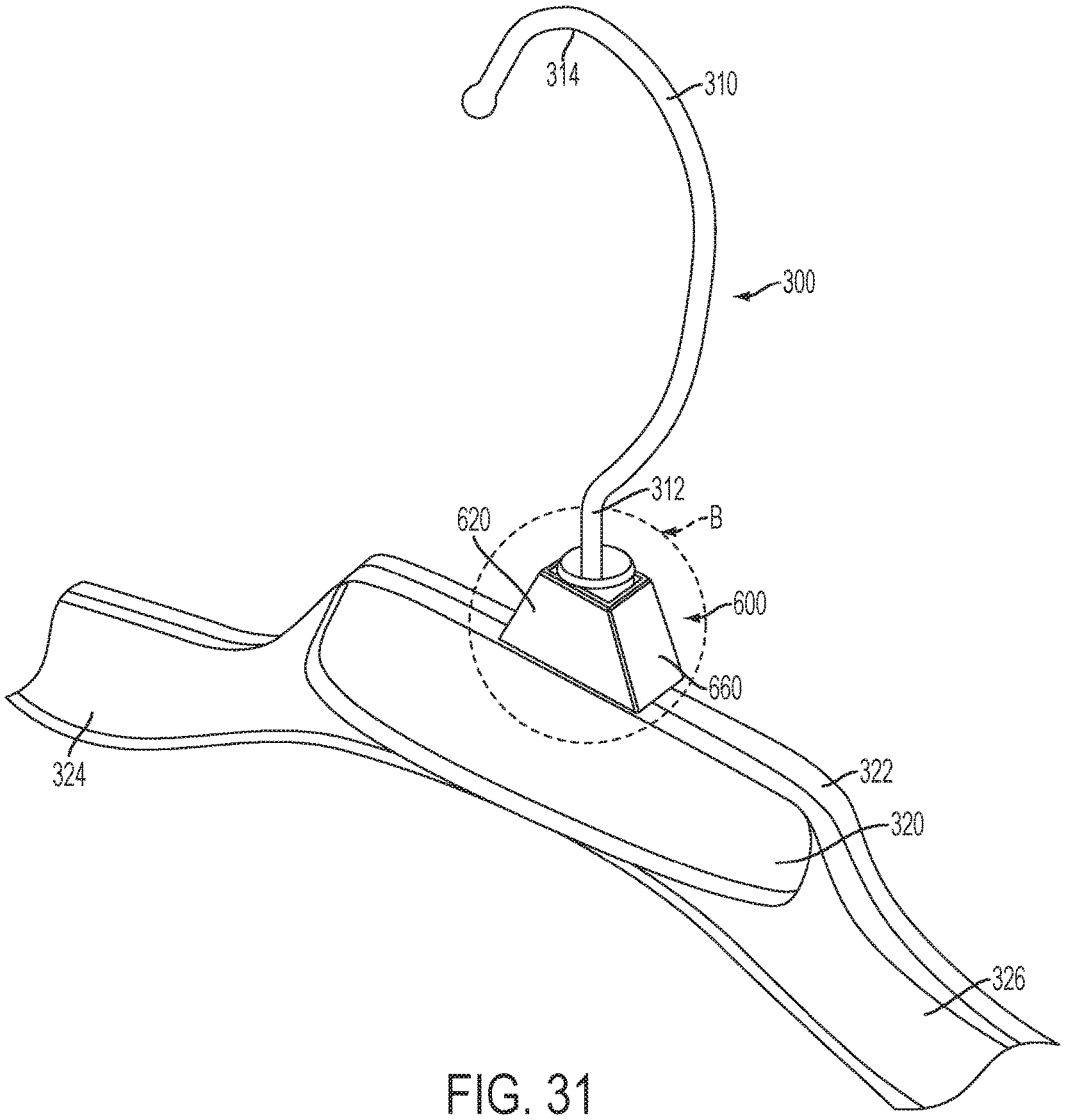
FIG. 31 illustrates a partial cutaway perspective view of a combination of a garment hanger and a reusable lower neck indicator according to another exemplary embodiment of the present invention.

FIG. 31 is a perspective view illustrating a combination of the garment hanger 300 and a reusable lower neck indicator 600 securely yet removably attached to the hanger 300 at a lower neck region of the hanger, for showing information related to a garment suspended by the hanger 300, such as the size of the garment.

Figure 32:
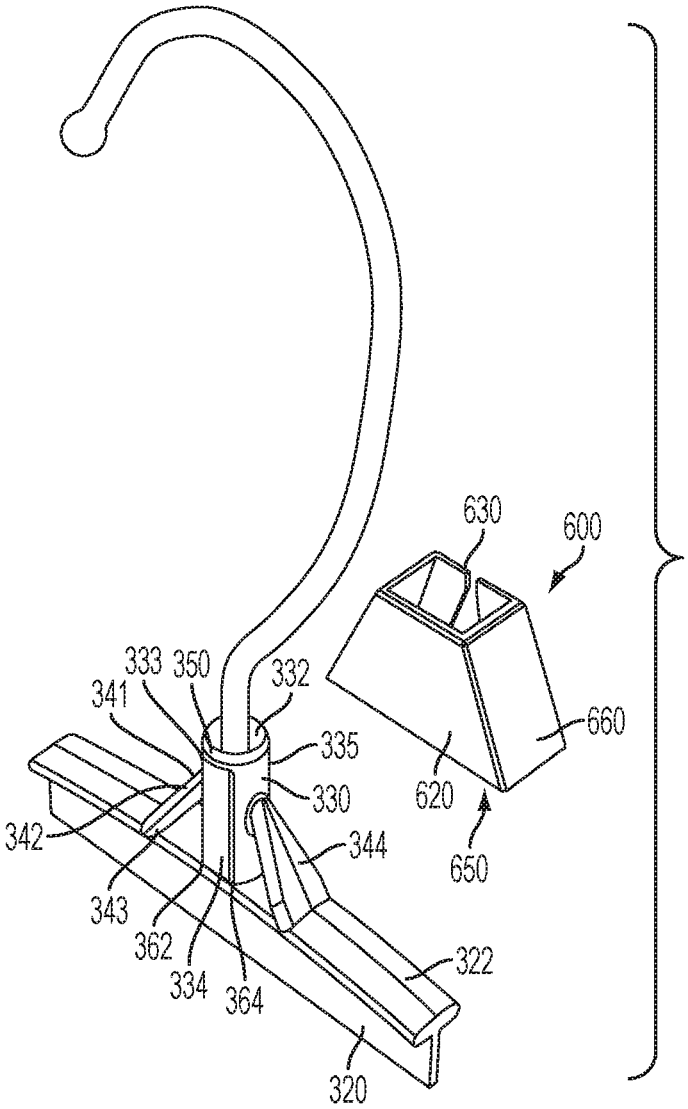
FIG. 32 illustrates a partial cutaway perspective view of the hanger and the indicator shown in FIG. 31.
Figure 33:
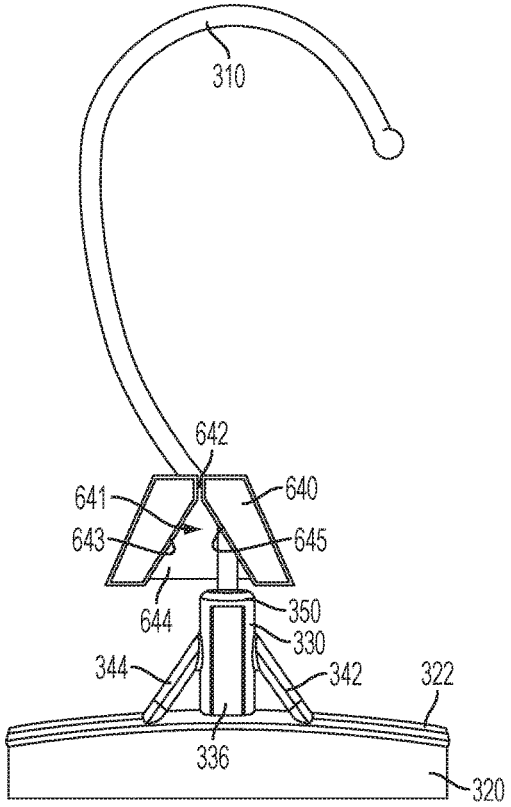
FIG. 33 illustrates a partial rear elevation view of the hanger and the indicator shown in FIG. 31.
Figure 34:
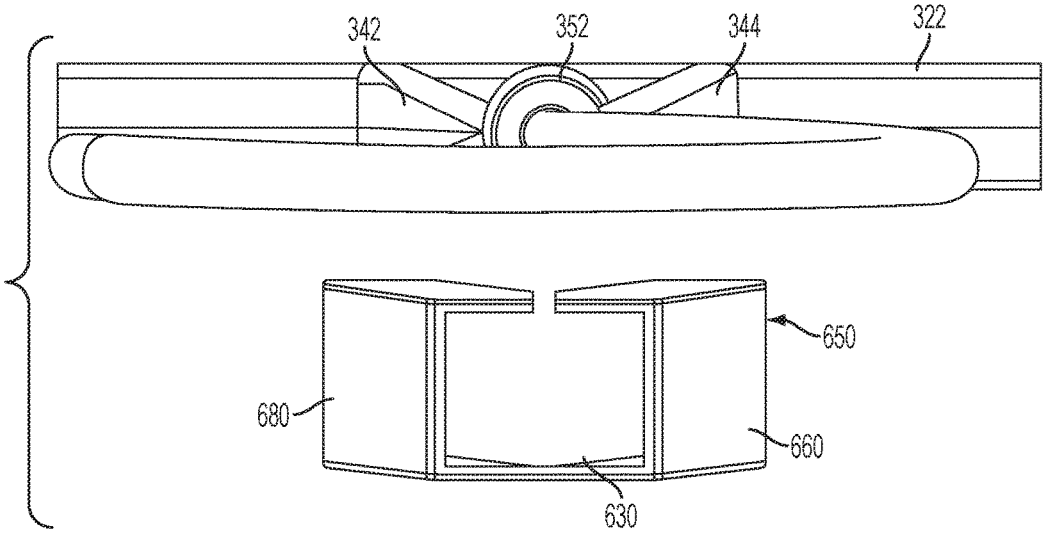
FIG. 34 illustrates a top view of the hanger and the indicator shown in FIG. 31.

FIG. 32 is a partial perspective illustrating the hanger 300 and the reusable lower neck indicator 600 separated from the hanger 300. FIG. 33 is a top view of the indicator 600.

As shown, the reusable lower neck indicator 600 includes a pair of opposite sidewalls, namely, an anterior wall 620 and a posterior wall 640. The reusable lower neck indicator 600 further includes a pair of opposite end walls, namely, a right end wall 660 and a left end wall 680. The end walls and the sidewalls are connected to each other to form a generally trapezoidal indicator body having four lower corners and four upper corners. The indicator 600 has a top opening 630 defined collectively by the top ends of the anterior wall 620, the posterior wall 640, the right end wall 660 and the left end wall 680. The indicator 600 further has a bottom opening 650, which is defined collectively by the bottom ends of the anterior wall 620, the posterior wall 640, the right end wall 660 and the left end wall 680.

The indicator 600 includes a discontinuity 641 traversing the height of the indicator to facilitate attaching the indicator 600 to the hanger 300 and removing the indicator 600 from the hanger. The discontinuity 641 communicates the top opening 630 with the bottom opening 650, such that a continuous path or passageway is provided between the top opening and the bottom opening. The discontinuity 641 extends along the posterior wall 640, which includes a slot 642 and a substantially triangle cutout 644 continuous with the slot 642. The slot 642 laterally extends through the thickness of the posterior wall 640 to be continuous with the top opening 630. The cutout 644 extends from the slot 642 to the lower end of the posterior wall 640, with the apex of the triangular cutout continuous with the slot 642. The cutout 644 is defined by a first edge 643 and a second edge 645 in the posterior wall 640. The slot 642 and the cutout 644, collectively, provide a path for admitting the hook 310 to the top opening 630 and the bottom opening 650. The triangular shaped cutout 644 facilitates the insertion of the hook 310 into the discontinuity.

During operation, a user manipulates the hook 310 and the indicator 600 to allow the hook 310 to approximate the discontinuity 641 through the cutout 644. The hook 310 is subsequently pushed against the slot 642 to enter the top opening 630. The slot 642 needs to be only as wide as necessary to allow the indicator 600 to admit the hook 310. For example, the slot 642 can be dimensioned to be slightly narrower than a size of the hook 310 (for example, the diameter of the hook), such that a force is needed to resilient expand the slot 642 to admit the hook 310. Once the hook 310 passes the slot 642, the posterior wall 640 returns to its original position prior to flexing, which can provide an acoustic feedback indicating that the hook 310 has entered the top opening 630.

In this embodiment, the indicator does not have a top wall for providing a top opening. Instead, the top opening is defined by the top ends of the sidewalls and end walls of the indicator.

A person of ordinary skill in the art understands that the discontinuity (such as the combination of the slot and the cutout) can be provided in any suitable wall of the indicator and the profile of the discontinuity can be varied without departing from the invention. For example, the discontinuity can be provided in the anterior wall, the posterior wall and/or any of the end walls of the indicator.

Figure 35:
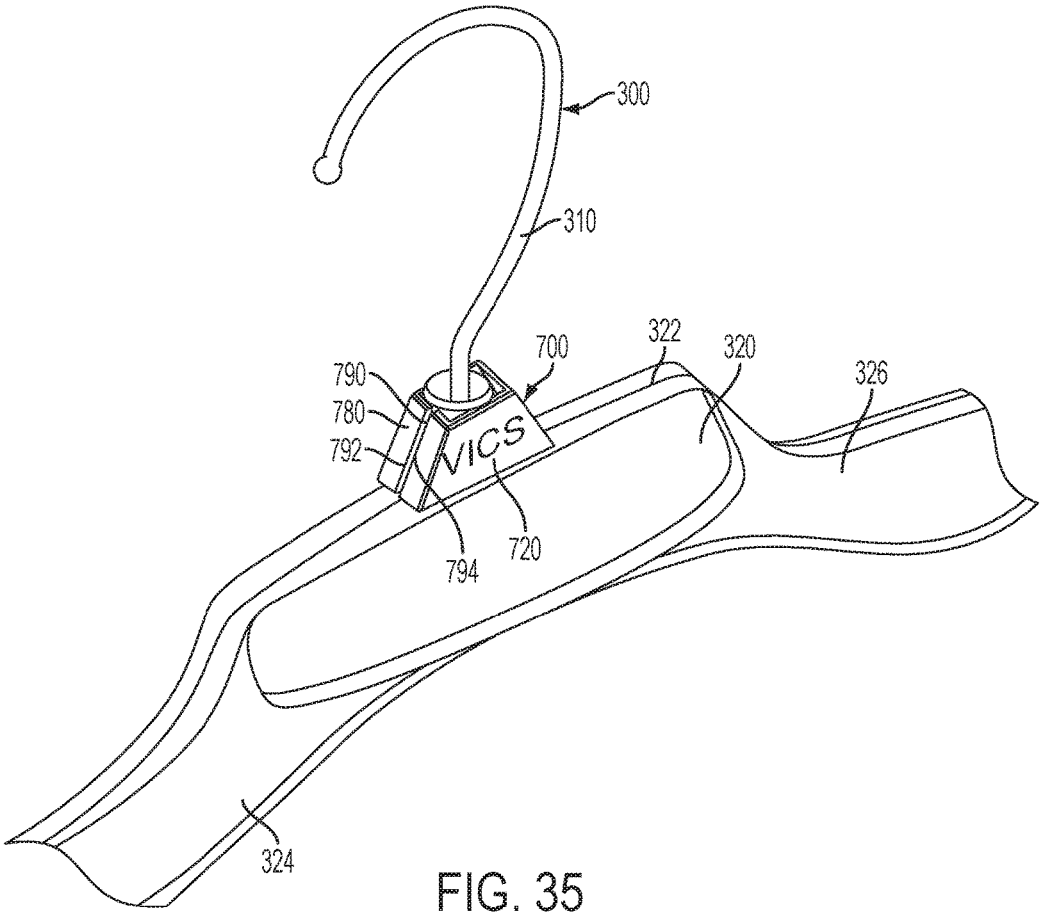
FIG. 35 illustrates a partial cutaway perspective view of a combination of a garment hanger and a reusable lower neck indicator according to another exemplary embodiment of the present invention.
Figure 36:
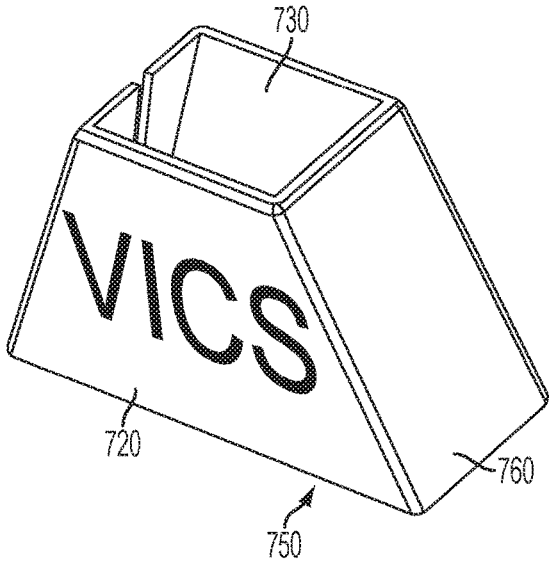
FIG. 36 illustrates a perspective view of the indicator shown in FIG. 35.
Figure 37:
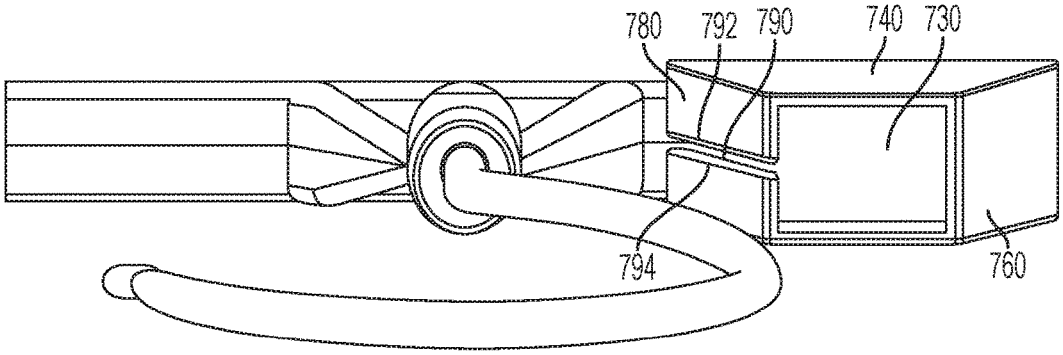
FIG. 37 illustrates a top view of the hanger and the indicator shown in FIG. 35.

FIGS. 35-37 depict another exemplary embodiment of the reusable lower neck indicator, identified by 700. The indicator 700 can be fixedly attached to the lower neck region B of the hanger 300; yet can be removed from the lower neck region for reuse purposes.

The indicator 700 includes a pair of opposite sidewalls, namely, an anterior wall 720 and a posterior wall 740. The indictor 700 further includes a pair of opposite end walls, namely, a right end wall 760 and a left end wall 780. The sidewalls and the end walls are connected form a generally trapezoidal indicator body having four lower corners and four upper corners. The indicator 700 further includes a top opening 730 defined collectively by the top ends of the anterior wall 720, the posterior wall 740, the right end wall 760 and the left end wall 780. The indicator 700 further has a bottom opening 750, which is defined collectively by the bottom ends of the anterior wall 720, the posterior wall 740, the right end wall 760 and the left end wall 780.

The lower neck indicator 700 includes a discontinuity 790 traversing the height of the indicator to facilitate attaching the indicator 700 to the hanger 300 by admitting the hook 310. The discontinuity 790 further facilitates to remove the indicator 700 from the hanger 300 by assisting deformation of the indicator. The discontinuity 790 is configured to communicate the top opening 730 and the bottom 750 of the indicator, thereby providing a continuous path along which the hook 310 can slide to enter the top opening 730 and the bottom opening 750. The discontinuity 790 is defined by a first edge 792 and an opposite second edge 794 extending from the lower end of the right end wall 780 to the top wall 710. The discontinuity 790 needs to be only as wide as necessary to allow the indicator 700 to admit the hook 310. For example, the discontinuity 790 can be slightly narrower than the hook 310 where the material selected for the indicator 700 can elastically deform to admit the hook 310. The ends of discontinuity 790 can be curved or chamfered to ease the insertion of the hook 310.

In this embodiment, the indicator does not have a top wall for providing a top opening. Instead, the top opening is defined by the top ends of the sidewalls and end walls of the indicator.

A person of ordinary skill in the art understands that the discontinuity (such as the combination of the slot and the cutout) can be provided in any suitable wall of the indicator and the profile of the discontinuity can be varied without departing from the invention. For example, the discontinuity can be provided in the anterior wall, the posterior wall and/or any of the end walls of the indicator.

Associated with the hanger 300 and the reusable lower neck indicators 400-700 according to another exemplary aspect of the present invention, a method of attaching an indicator to a lower neck region of a hanger is provided. The hanger includes a hanger body, a post extending upwardly from the hanger body for receiving a hanger hook therein and an indicator retaining member associated with the post for engaging the indicator. The lower neck region is defined by the intersection of the hanger body and the post. The indicator has a top opening and a bottom opening for admitting the post of the hanger.

The attaching method includes inserting the hook into an admitting end (such as, the expanded end of the cutout 444 or the lower end 592 of the discontinuity 590) of a discontinuity (such as, the discontinuity 441 and 590), moving the hook along the discontinuity to allow the hook to enter the top opening and the bottom opening, and manipulating the indicator to engage the indicator with the indicator retaining member. The discontinuity communicates the top opening and the bottom opening and is dimensioned to admit the hook.

The engagement between the indicator and the indicator retaining member expands the top opening of the indicator to position the indicator at the lower neck region. For example, the indicator retaining member can be the ring 350 disposed at the top of the post 330, and the engagement between the ring 350 and the top wall 410 of the indicator 410 expands the top opening 430 to position the top wall 410 under the top ring 350.

Preferably, the indicator includes opposite front and rear sidewalls and opposite left and right end walls, which defines a substantially trapezoidal profile of the indicator. Preferably, the discontinuity includes comprises a substantially consistent discontinuity in at least one of the end walls. Preferably, the discontinuity is disposed in at least one of the sidewalls, which includes a lower cutout continuous with the bottom opening of the indicator and an upper slot continuous with the top opening of the indicator. Preferably, the lower cutout is a substantially triangular with the apex thereof continuous with the upper slot.

This attaching method can be implemented manually by a user with his/her fingers, or manually by a user with a special tool. Alternatively, this method can be implemented automatically by a specially designed machine to achieve high efficiency for handling hangers and indicators.

Associated with the hanger 300 and the reusable lower neck indicators 400 and 500 and according to another exemplary aspect of the present invention, a method of removing an indicator from a lower neck region of a hanger is provided. The hanger includes a hanger body, a post extending upwardly from the hanger body for receiving a hanger hook therein and an indicator retaining member associated with the post for engaging the indicator. The lower neck region of the hanger is defined by the intersection of the hanger body and the post. The indicator has a top opening and a bottom opening. The removing method includes flexing the indicator to partially deform the indicator along a discontinuity of the indicator, disengaging the indicator from the indicator retaining member of the hanger upon the deformation of the indicator, and separating the indicator from the hanger. The discontinuity communicates with the top opening and the bottom opening and is continuous with both openings.

Preferably, the indicator can be separated from the hanger by ejecting the indicator from the post of the hanger upon the deformation of the indicator and moving the hook along the discontinuity to discharge the hook from the top opening.

Preferably, the indicator includes opposite front and rear sidewalls and opposite left and right end walls, which define a substantially trapezoidal profile of the indicator. The discontinuity includes a substantially consistent slot in at least one of the end walls. The discontinuity includes a lower cutout continuous with the bottom opening of the indicator and an upper slot continuous with the top opening of the indicator in at least one of the sidewalls. More preferably, the lower cutout is substantially triangular with the apex thereof continuous with the upper slot.

This removing method can be implemented manually by a user with his/her fingers, or manually by a user with a special tool. Alternatively, this method can be implemented automatically by a specially designed machine to achieve high efficiency for handling hangers and indicators.

Associated with the hanger 300 and the reusable lower neck indicators 400 and 500 and according to another exemplary aspect of the present invention, a method of manipulating a garment hanger and an indicator mountable to a lower neck region of a garment hanger. The hanger includes a hanger body, a post extending upwardly from the hanger body for receiving a hanger hook therein and an indicator retaining member associated with the post for engaging the indicator. The lower neck region of the hanger is defined by the intersection of the hanger body and the post. The indicator has a top opening and a bottom opening.

The method includes inserting the hook into an admitting end of a discontinuity, moving the hook along the discontinuity to allow the hook to be positioned within the top opening and the bottom opening, manipulating the indicator to engage the indicator with the indicator retaining member, expanding the top opening of the indicator through the engagement between the indicator and the indicator retaining member to position the indicator at the lower neck region. The discontinuity communicates the top opening and the bottom opening and is dimensioned to admit the hook. The method further includes flexing the indicator to partially deform the indicator along the discontinuity of the indicator, disengaging the indicator from the indicator retaining member of the hanger upon the deformation of the indicator and separating the indicator from the hanger.

This manipulating method can be implemented manually by a user with his/her fingers, or manually by a user with a special tool. Alternatively, this method can be implemented automatically by a specially designed machine to achieve high efficiency for handling hangers and indicators.

The above-described methods for attaching an indicator to a hanger, removing an indicator from a hanger and manipulating a hanger and an indicator can be applied in connection with a hanger/indicator reuse methodology described in co-owned U.S. Pat. No. 6,523,240. For example, the hangers and indicators can be manually or automatically selected, examined, separated, cleaned, sorted, transported, recycled and so on, for reuse purposes, the reuse methodology. The different steps of the reuse method can be implemented at different locations to enhance the processing efficiency. For example, different processing centers, such as a center designated for separating the indicator and the hanger, can be set up for automatically implementing one or more of the reuse steps. The operations of the different centers can be controlled and coordinated through a computer system.

In the disclosed invention, secure and reliable attachment of the lower neck indicators can be implemented through the engagement between the post flange and the resilient tabs of the indicator or the engagement between the post ring and the top wall of the indicator, without contradicting with the removable characteristics of indicators. Thus, accidental and unintentional separation of the indicators from the hangers can be effectively avoided. The hanger and indicator combination according to the present invention is "child proof".

The plastic hanger of the present invention can be formed of styrene. In the alternative, the hanger can be molded from polypropylene, preferably H.I. styrene polypropylene, polyvinylchloride, ABS or other suitable thermoplastics and mixtures thereof. For additional reinforcement, K resin can be added to the plastic material.

From the foregoing illustrations it is readily apparent that the present invention is directed to an improved hanger and indicator combination suitable for industry mass production. The combination of the present invention offers reliable fixation between the hanger and the indicator, satisfying industry standards, such as, the VICS standards.

The present invention has been described with respect to certain exemplary embodiments. Certain alterations and/or modifications will be apparent to those skilled in the art, in light of the instant disclosure, without departing from the spirit or the scope of the invention. These embodiments are offered as merely illustrative, and not limiting, on the scope of the invention, which is defined solely with reference to the following appended claims.

I claim:

1. A method for removing an indicator from a hanger, the hanger comprising a hanger body, a post extending upwardly from the hanger body and an indicator retaining member associated with the post for engaging the indicator to position the indicator at a lower neck region of the hanger defined by the intersection of the hanger body and the post, said method comprising:

deforming the indicator by engaging the indicator with at least one interfering structure provided on the hanger, to disengage the indicator from the indicator retaining member; and separating the indicator from the hanger, wherein the at least one interfering structure comprises an expanded bottom end of a strut disposed angularly between the hanger body and the post, the expanded bottom end having a lateral width substantially equal to a lateral width of the hanger body.

2. The method of claim 1, wherein the indicator comprises at least one elevation disposed on an inner surface of the indicator, wherein the at least one elevation faces the expanded bottom end of the strut when the indicator is positioned at the lower neck region.

3. The method of claim 2, wherein the at least one projection comprises a substantially semi-spherical projection on a front surface of the post at a location adjacent the top of the post or a rib extending between the top of the post and the hanger body.

4. The method of claim 1, wherein the at least one interfering structure further comprises at least one projection on a surface of the post.

5. The method of claim 1, wherein the step of deforming comprises twisting the indicator with respect to the at least one interfering structure in a plane substantially perpendicular to the post.

6. A method for manipulating a garment hanger and an indicator mountable to a lower neck region of a garment hanger, the hanger comprising a hanger body, a post extending upwardly from the hanger body for receiving a hanger hook therein and an indicator retaining member associated with the post for engaging the indicator, the intersection of the hanger body and the post defining the lower neck region of the hanger, said method comprising:

feeding the indicator over the hook of the hanger;

sliding the indicator downwardly along the hook to approach the indicator retaining member;

engaging the indicator with the indicator retaining member to resiliently expand a top opening of the indicator and to allow the indicator to pass over the indicator retaining structure;

positioning the indicator at the lower neck region;

deforming the indicator by engaging the indicator with at least one interfering structure provided on the hanger, to disengage the indicator from the indicator retaining member; and separating the indicator from the hanger, wherein the at least one interfering structure comprises an expanded bottom end of a strut disposed angularly between the hanger body and the post, the expanded bottom end having a lateral width substantially equal to a lateral width of the hanger body.

7. The method of claim 6, wherein the indicator comprises at least one elevation disposed on an inner surface of the indicator, wherein the at least one elevation faces the expanded bottom end of the strut when the indicator is positioned at the lower neck region.

8. The method of claim 7, wherein the at least one projection comprises a substantially semi-spherical protrusion on a front surface of the post at a location adjacent the top of the post or a rib extending between a top of the post and the hanger body.

9. The method of claim 6, wherein the at least one interfering structure further comprises at least one projection on a surface of the post.

10. The method of claim 6, wherein the step of deforming comprises twisting the indicator with respect to the at least one interfering structure in a plane substantially perpendicular to the post.

* * * * *